US008234833B2

(12) United States Patent
Miller

(10) Patent No.: US 8,234,833 B2
(45) Date of Patent: Aug. 7, 2012

(54) STRUCTURAL INSULATED ROOF PANELS WITH RIGID FOAM CORE

(76) Inventor: Kenneth Andrew Miller, Henderson, NV (US)

( * ) Notice: Subject to any disclaimer, the term of this patent is extended or adjusted under 35 U.S.C. 154(b) by 0 days.

(21) Appl. No.: 12/077,756

(22) Filed: Mar. 20, 2008

(65) Prior Publication Data

US 2009/0235598 A1 Sep. 24, 2009

(51) Int. Cl.
*E04B 1/00* (2006.01)
*E04C 1/00* (2006.01)

(52) U.S. Cl. ..... 52/745.05; 52/309.7; 52/309.1; 52/220.7

(58) Field of Classification Search ..... 52/309.7, 52/309.1, 309.4, 764, 780, 309.2, 269, 267, 52/265, 220.7, 745.05
See application file for complete search history.

(56) References Cited

U.S. PATENT DOCUMENTS

| | | | | |
|---|---|---|---|---|
| 832,290 | A | 10/1906 | Brown | |
| 3,353,315 | A * | 11/1967 | Barker | 52/275 |
| 4,435,936 | A * | 3/1984 | Rutkowski | 52/481.1 |
| 4,465,734 | A | 8/1984 | Laroche et al. | |
| 4,628,650 | A | 12/1986 | Parker | |
| 4,641,468 | A * | 2/1987 | Slater | 52/309.4 |
| 4,641,469 | A * | 2/1987 | Wood | 52/309.12 |
| 4,866,891 | A | 9/1989 | Young | |
| 4,936,069 | A | 6/1990 | Hunter et al. | |
| 4,961,298 | A * | 10/1990 | Nogradi | 52/235 |
| 5,285,607 | A | 2/1994 | Somerville | |
| 5,384,998 | A | 1/1995 | Tanaka et al. | |
| 5,799,462 | A * | 9/1998 | McKinney | 52/742.13 |
| 5,842,276 | A * | 12/1998 | Asher et al. | 29/897.32 |
| 5,893,248 | A * | 4/1999 | Beliveau | 52/309.7 |
| 5,943,775 | A | 8/1999 | Lanahan et al. | |
| 6,041,561 | A * | 3/2000 | LeBlang | 52/234 |
| 6,167,624 | B1 | 1/2001 | Lanahan et al. | |
| 6,363,674 | B1 * | 4/2002 | Carver | 52/309.8 |
| 6,408,594 | B1 * | 6/2002 | Porter | 52/794.1 |
| 6,742,974 | B2 * | 6/2004 | Haire | 410/115 |
| 6,796,093 | B2 | 9/2004 | Brandes | |

(Continued)

FOREIGN PATENT DOCUMENTS

DE 25 03 429 7/1976

OTHER PUBLICATIONS

PCT Search Report dated Jan. 14, 2010.

*Primary Examiner* — Mark Wendell
(74) *Attorney, Agent, or Firm* — Salter IP Law; Jim H. Salter

(57) ABSTRACT

A structural insulated roof panel with a rigid foam core is disclosed. A particular embodiment includes a rigid foam core having first and second faces, a plurality of support channels being formed on the first and second faces of the rigid foam core, each of the support channels being formed in the rigid foam core with at least one bend; and a plurality of supports being insertable into the plurality of support channels such that at least one face of each of the plurality of supports is external to the first and second faces of the rigid foam core and substantially flush with a face of the rigid foam core, each of the plurality of supports being fabricated using at least four bends to produce a support that fits within one of the plurality of support channels.

8 Claims, 29 Drawing Sheets

U.S. PATENT DOCUMENTS

| | | | | |
|---|---|---|---|---|
| 6,892,507 | B1 * | 5/2005 | Pease | 52/794.1 |
| 8,109,055 | B2 * | 2/2012 | Miller | 52/220.7 |
| 8,109,058 | B2 * | 2/2012 | Miller | 52/309.7 |
| 2002/0170250 | A1 | 11/2002 | Chambers | |
| 2004/0068948 | A1 * | 4/2004 | Wrass | 52/309.7 |
| 2005/0204697 | A1 * | 9/2005 | Rue | 52/782.1 |
| 2005/0257494 | A1 * | 11/2005 | Brandes | 52/782.1 |
| 2006/0075701 | A1 * | 4/2006 | Cretti | 52/223.8 |
| 2006/0117689 | A1 * | 6/2006 | Onken et al. | 52/309.7 |
| 2007/0227086 | A1 * | 10/2007 | Beavers et al. | 52/309.7 |

* cited by examiner

STRUCTURAL INSULATED ROOF PANELS WITH RIGID FOAM CORE

BACKGROUND

1. Technical Field

This disclosure relates to insulated structural panels used in building construction. In particular, the present disclosure relates to insulated structural roof panels including a combination of structural metal components and rigid foam insulation.

2. Related Art

Traditional building construction typically uses wood or metal stud framing with fiberglass insulation enclosed with a drywall interior wall and a wood or stucco exterior wall. These types of conventional structures do not have efficient thermal insulating properties, use many types of non-recyclable materials, and are labor-intensive to build.

More recently, prefabricated panels made of two sheets of plywood or oriented strand board (OSB) with rigid foam insulation between the boards have been used to construct walls, floors, and/or roofs of buildings. These prefabricated panels, called "structural insulated panels" (SIP) may be fabricated at a manufacturing plant and shipped to a jobsite for rapid erection of a building. The SIP's are stronger and have better insulation properties than a framed lumber building. However, SIP's also have inefficient thermal insulation properties and can be susceptible to insect infestation, wood decay from excessive trapped moisture, mold, and/or mildew.

U.S. Patent Application No. 20060117689, filed on Nov. 18, 2005, and names Ronnie and Yelena Onken as inventors (herein the Onken patent application) describes an insulated structural panel formed with a rigid foam core, a plurality of vertical hat channels on either face of the rigid foam core, and horizontal top and bottom L-channels on either face of the rigid foam core. The plurality of vertical hat channels on opposing faces of the rigid foam core is attached together so as to compress the rigid foam core, thus adding structural strength to the insulated structural panel. However, the ties used to attach the hat channels in the Onken patent application create undesirable thermal bridging between the opposing faces of the rigid foam core. This undesirable thermal bridging reduces the thermal insulation efficiency of the Onken panel. Further, the vertical hat channel described in the Onken patent application is expensive to manufacture and uses an excessive amount of material in the fabrication of the hat channel.

Typical existing SIP's that utilize a rigid foam core and hat channel studs often require a mechanical fastener. Typical existing SIP's that utilize rigid foam core and hat channel studs typically have a void between an opposing face of the studs to allow for the mechanical fastener between the parallel hat channels. This void makes it more difficult to attach interior and exterior sheathing. The mechanical fastener provides a thermal bridge and diminishes the insulating value of the panel making the structure less energy efficient. Typical SIP's that utilize a rigid foam core and hat channel studs have notches that are cut out of the foam. The overall insulating value of the panel is less than a panel without notches cut out. Typical SIP's that utilize a rigid foam core and hat channel studs are glued to adjacent panels, but the connection is still a hinge point with no structural value for bending. Consequently, the panel spans between the top and bottom plates or foundation. Typical SIP's that utilize a rigid foam core and hat channel studs typically have a glued butt connection at the corners. This butt connection is of minimal structural value and does not allow for ready attachment of interior sheathing.

Typical SIP's that utilize a rigid foam core and hat channel studs require a stiffened lip to take advantage of the bending strength of the section, due to flange buckling effects seen in sections of this type.

U.S. Pat. No. 5,921,046 describes a building assembly for efficiently and economically constructing walls, roofs, and floors using a prefabricated building panel made essentially of a plastic foam core with a thin coating of plastic resin or acrylic and portland cement applied on each side for structural rigidity, the building panel having a standardized semicircular recess disposed about its perimeter for receiving presized, cylindrical connectors also made of foam with a coating, and half-round connectors that connect the panel to a slab, and that also fit in the horizontal perimeter recesses of each panel.

Thus, a structural insulated roof panel with a rigid foam core is needed.

BRIEF DESCRIPTION OF THE DRAWINGS

Embodiments illustrated by way of example and not limitation in the figures of the accompanying drawings, in which.

DETAILED DESCRIPTION

A structural insulated roof panel with a rigid foam core is disclosed. In the following description, numerous specific details are set forth. However, it is understood that embodiments may be practiced without these specific details. In other instances, well-known processes, structures and techniques have not been shown in detail in order not to obscure the clarity of this description.

As described further below, according to various example embodiments of the disclosed subject matter described and claimed herein, there is provided systems and methods for fabricating and using a structural insulated panel with a rigid foam core without thermal bridging and a structural insulated roof panel with a rigid foam core. In a particular embodiment, the panel includes a 4-bend metal hat channel stud embedded in expanded polystyrene foam (EPS) and connected with metal angle braces at the edges to form a rigid panel suitable for the construction of buildings and the like. In particular embodiments, a novel panel is disclosed that has no thermal or sound bridge between the faces via mechanical fasteners. The disclosed panel of various embodiments is more cost efficient in terms of labor to manufacture and materials due to the absence of a requirement for mechanical fasteners between the parallel hat channel sections. Further, the disclosed panel is more suitable to attachment of interior sheathing and does not require the removal of large portions of foam to place the studs thereby lowering the insulating value of the panel. Further, the disclosed panel of various embodiments provides for composite action between the studs and the foam making the panel much stiffer than one that utilizes a mechanical fastener spaced at intervals along the axial length of the panel sections. Further, the disclosed panel of various embodiments provides a continuous locking connection between adjacent panels to facilitate the transfer of pending from one panel to the next allowing the panel to span in two directions instead of a one way span allowing the panel to carry substantially more load, thereby lowering the cost of materials, labor, and shipping. Further, the disclosed panel of various embodiments does not require the use of stiffeners or ties between studs; because, the rigid foam braces the flanges of the stud. Thus, the stud can be made less expensively with four bends instead of six. This helps not only with bending capacity of the stud but with compressive capacity of the design as well. Various embodiments are described below in connection with the figures provided herein.

Figure 1:
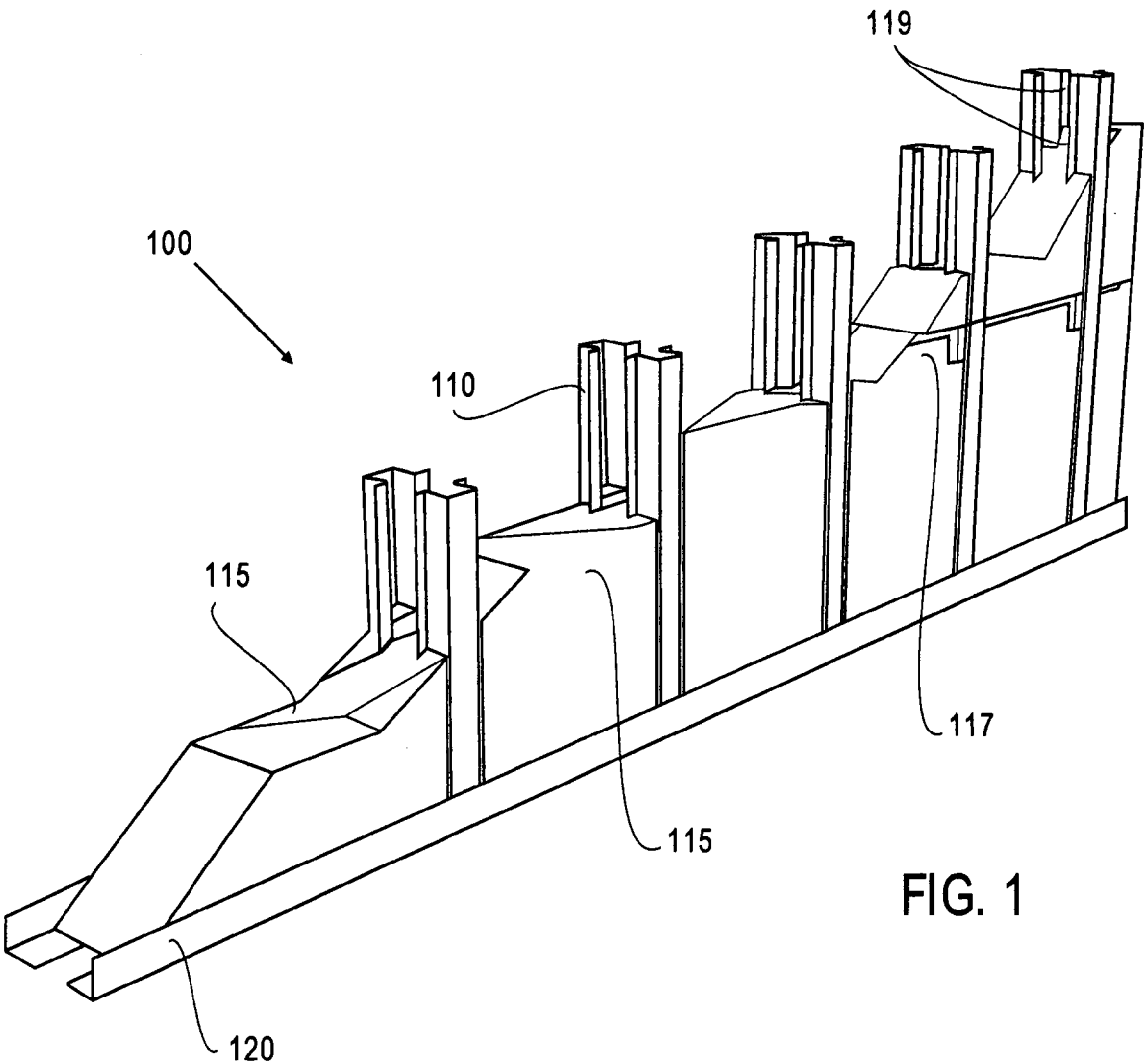
FIG. 1 is a cutaway diagram illustrating an insulated panel according to an example embodiment.

Referring to FIG. 1, a cutaway diagram illustrates an insulated panel 100 comprising one or more studs 110 embedded in expanded polystyrene foam (EPS) 115 and connected with metal angle braces 120 at the edges to form a rigid panel 100. In a particular embodiment, the studs 110 are each a 4-bend metal hat channel stud shown in cross-section in FIG. 4. Each stud 110 is embedded in the EPS 115 so that only a single outer face of the stud 110 is substantially flush with the outer face of EPS 115. Angle braces 120, formed in a particular embodiment as an L-shaped member, are connected to studs 110 in a substantially perpendicular arrangement as shown in FIG. 1. Bolts, screws, or welds can be used to bind each stud 110 to the angle braces 120. As shown in FIG. 1, the opposing angle braces 120 capture the EPS 115 at each edge.

As shown in FIG. 1, hat channel studs 110 are not attached to each other (as show by reference 119) thereby eliminating the presence of a thermal or sound bridge between the faces of the panels. The hat channel studs 110 are embedded into the rigid foam 115 with minimal perturbation to the foam and may be slid into place in a void provided in rigid foam 115. In some cases, a lubricating adhesive including a bonding agent can be used to facilitate sliding stud 110 into rigid foam 115 and locking stud 110 into rigid foam 115 via the adhesive agent. In a particular embodiment, hat channel stud 110 can be produced using no more than four bends to produce a stud with a hat channel shape in cross-section. In various embodiments, additional bends in stud 110 are not necessary as a sufficient level of stiffness is achieved using the structural properties of rigid foam 115 to fully brace the flanges of studs 110. Because studs 110 in various embodiments described herein can be produced with no more than four bends, manufacture of the studs 110 in various embodiments is less expensive, less complicated, and uses less material to produce the stud 110.

Figure 2:
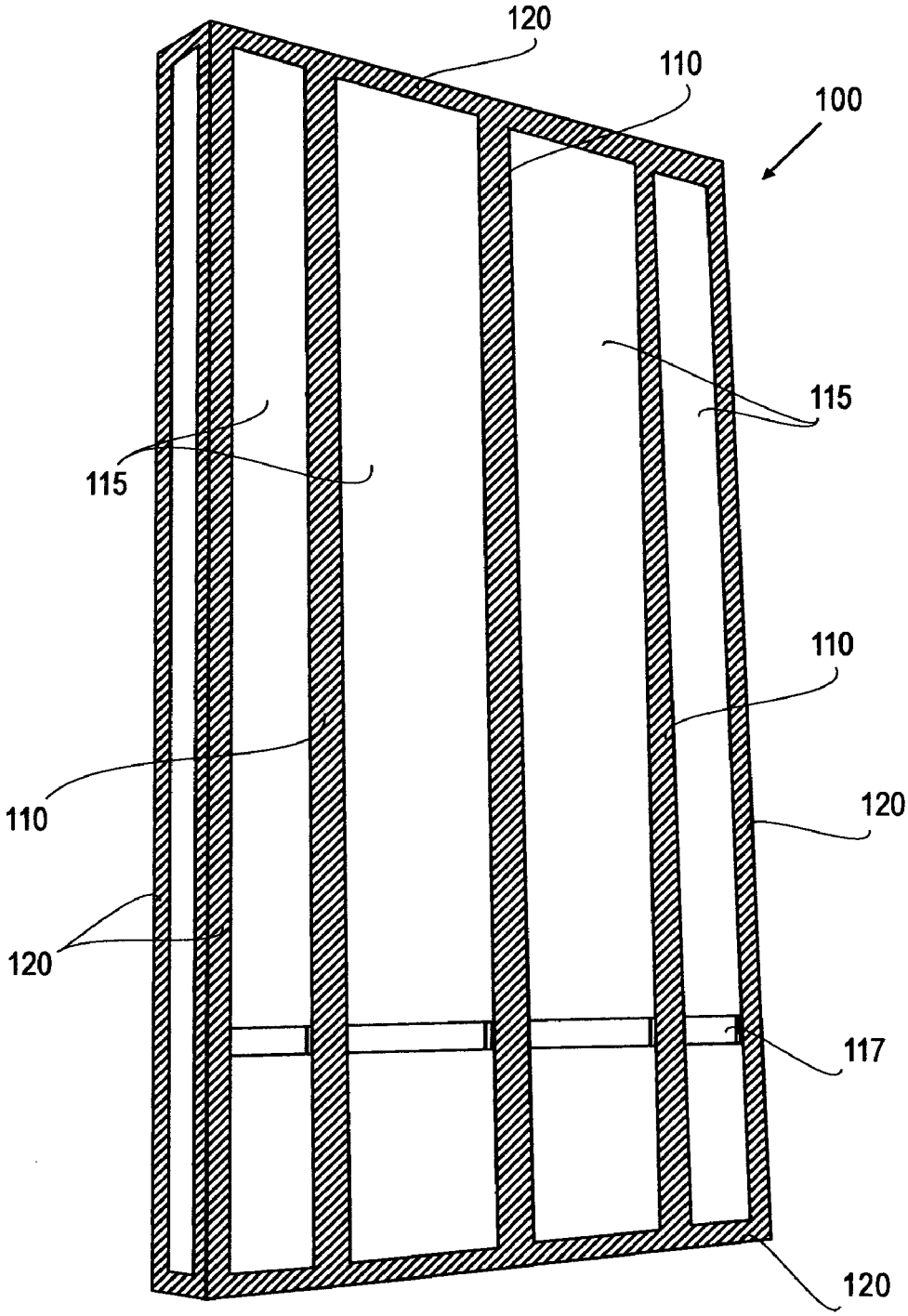
FIG. 2 illustrates a straight panel according to an example embodiment.

FIG. 2 illustrates a straight panel 100 with studs 110, angle braces 120, and rigid foam core 115. An electrical or plumbing chase 117 is also shown as a cut-out portion of the foam 115.

Figure 3:
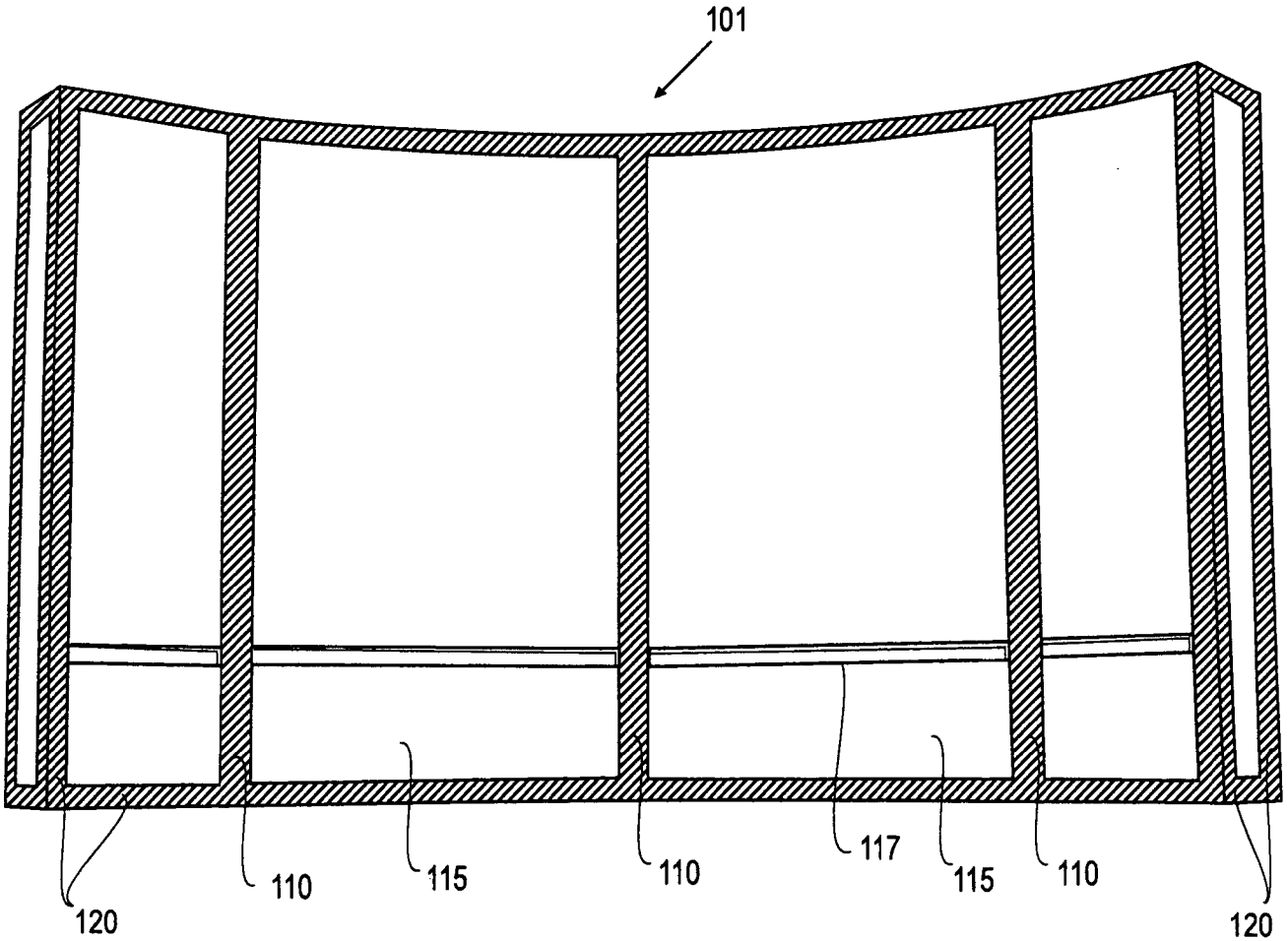
FIG. 3 illustrates a curved panel according to an example embodiment.

FIG. 3 illustrates a curved panel 101 with studs 110, angle braces 120, and rigid foam core 115. An electrical or plumbing chase 117 is also shown as a cut-out portion of the foam 115.

Figure 4A:
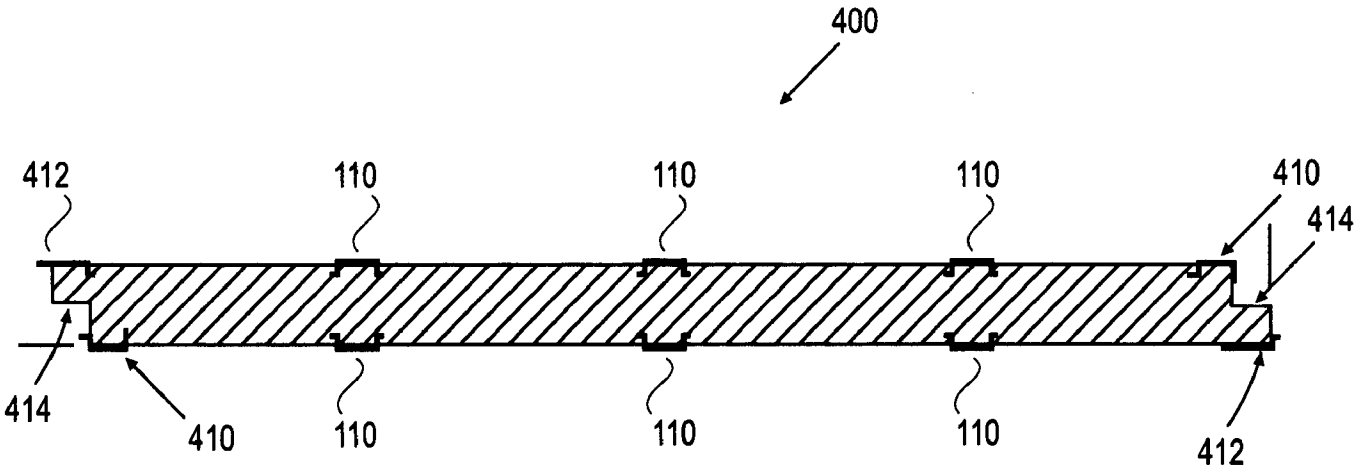
FIGS. 4A and 4B illustrate a straight panel with studs in cross section showing the 4-bend stud according to an example embodiment.
Figure 4B:
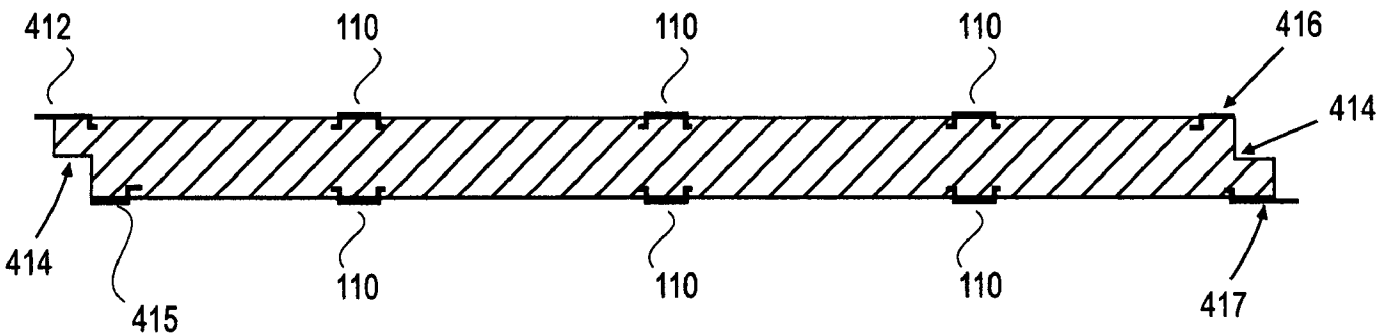

FIGS. 4A and 4B illustrate a straight panel 400 with studs 110 in cross section showing the 4-bend stud. In FIG. 4A, a 2-bend flashing hat member 412 is also shown at both ends of the panel. A 3-bend hat member 410 is also shown at both ends of the panel. In FIG. 4B, 2-bend flashing hat members 412, 415, 416, and 417 are also shown at both ends of the panel. A lap joint with an expansive adhesive 414 is also shown at both ends of the panel.

Figure 5:
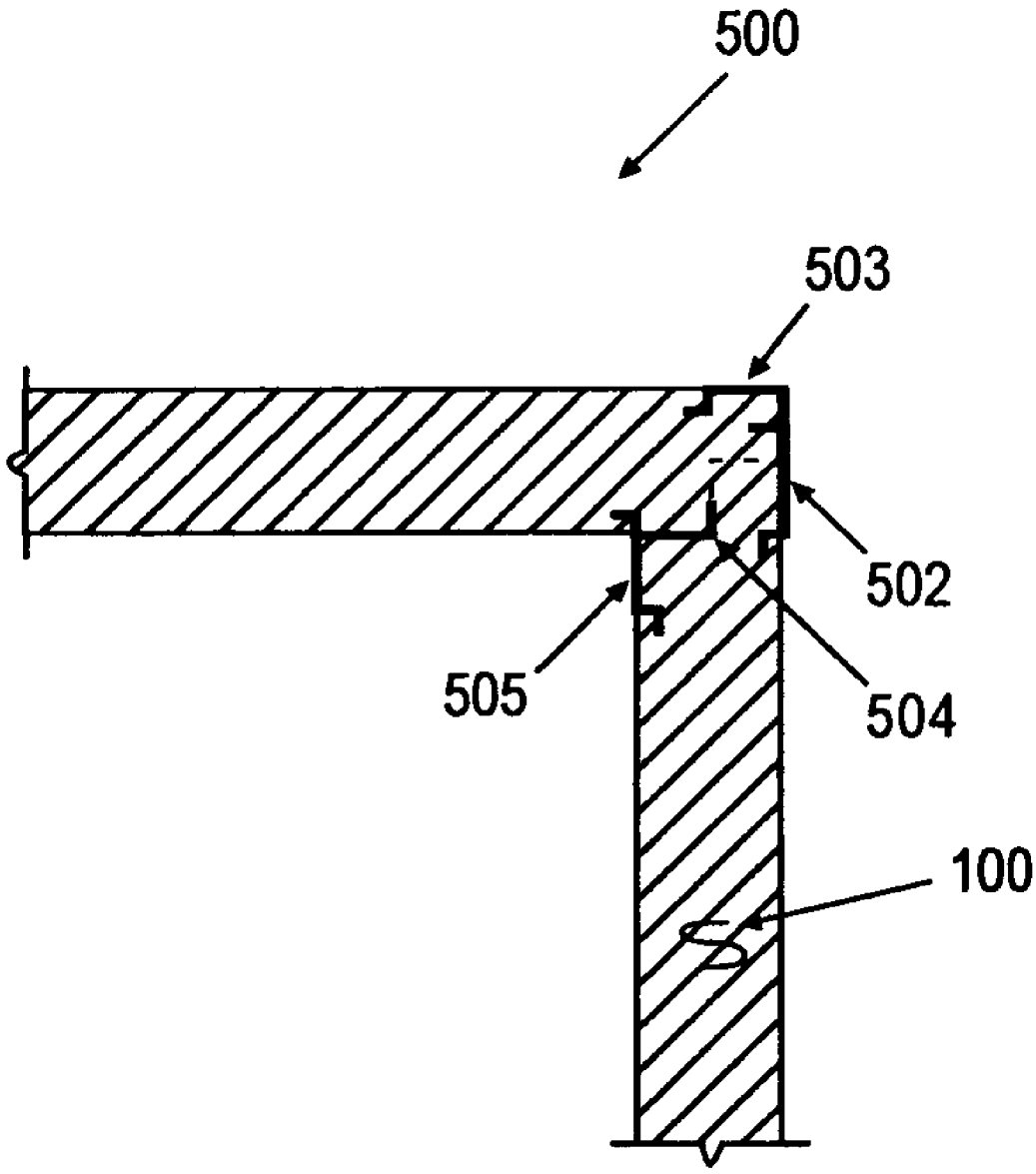
FIG. 5 illustrates a corner lap in a particular embodiment.

FIG. 5 illustrates a corner lap in a particular embodiment. A 2-bend flashing 502 is shown. A 2-bend flashing hat with third field bend 503 is also shown. A lap joint with an expansive adhesive 504 is also shown. A 3-bend hat member 505 is also shown.

Figure 6:
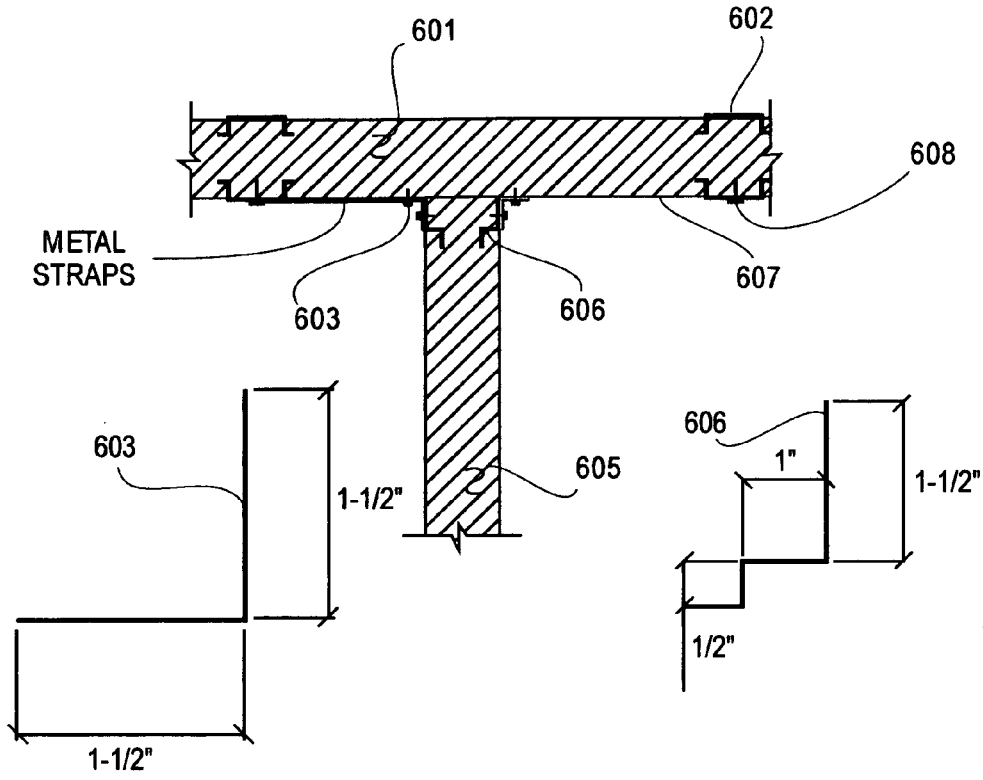
FIG. 6 illustrates a panel to panel connection (join) in a particular embodiment.

FIG. 6 illustrates a panel to panel connection in a particular embodiment. An exterior panel 601 is shown. Studs 602 are also shown. The assembly shown in FIG. 6 is used to join a second panel 605 to panel 601 in a perpendicular orientation. To accomplish this join, a side of panel 601 is fitted with a flat metal strap 607 that can be attached to panel 601 with metal screws or bolts 608 attached at studs 602 as shown in FIG. 6. The join assembly shown in FIG. 6 includes an embedded fitting 606 that includes a first surface that is embedded into panel 605 and a second surface that is exposed at an end of panel 605. In this manner, embedded fitting 606 is secured to panel 605. As shown in FIG. 6, an embedded fitting 606 is provided on both sides of panel 605. The join assembly shown in FIG. 6 further includes a corner fitting 603 that includes a first surface positioned flush with the exposed surface of embedded fitting 606 and secured thereto with a metal screw or bolt. Corner fitting 603 includes a second surface positioned flush with the metal strap 607 on panel 601 and secured thereto with a metal screw or bolt. In this manner, embedded fitting 606 and corner fitting 603 can be used to secure panel 605 to panel 601 in a perpendicular orientation.

Figure 7:
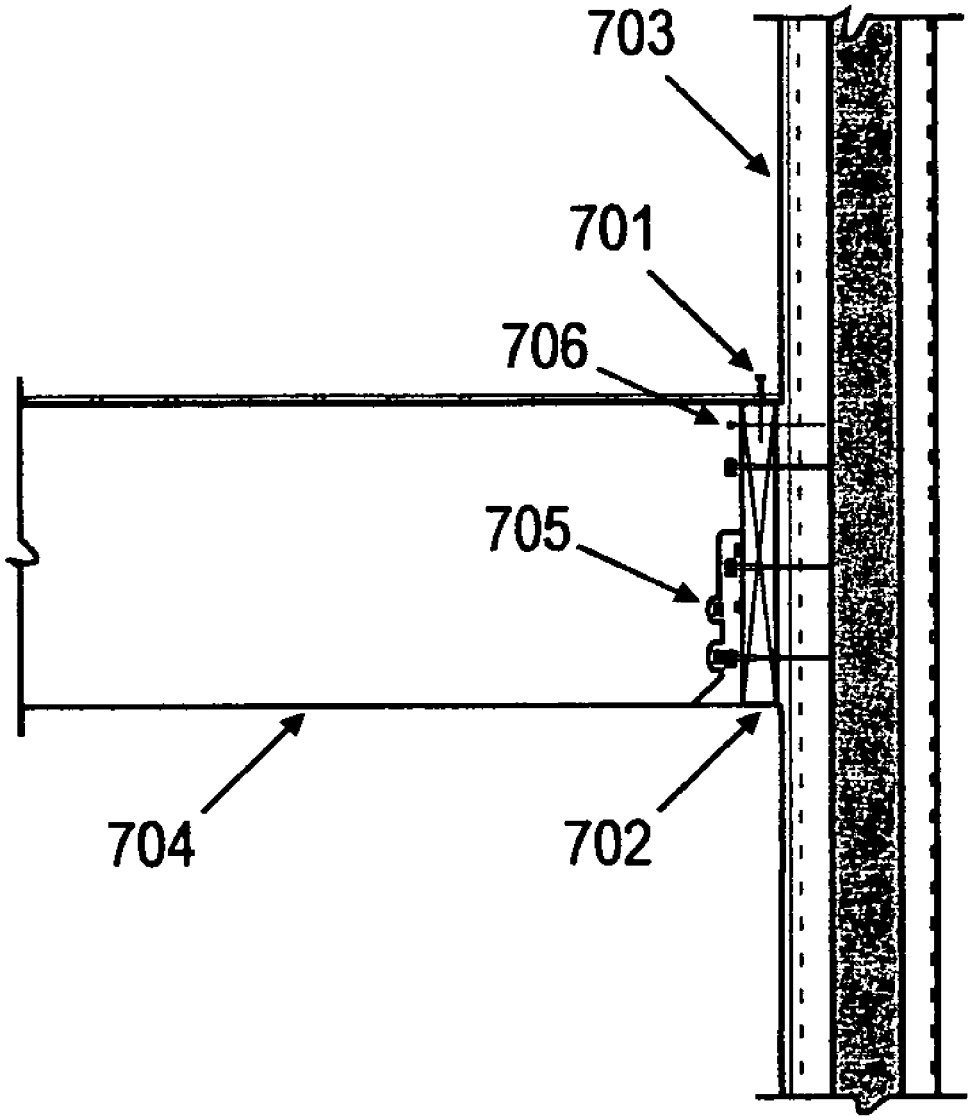
FIG. 7 illustrates a wood joist mounting at a panel in a particular embodiment.

FIG. 7 illustrates a wood joist mounting at a panel in a particular embodiment. An edge nailing 701 is shown. A wood ledger 702 is shown. A shearwall sheathing 703 is shown. A wood joist 704 is shown. A conventional hanger 705 is shown. A block 706 is also shown.

Figure 8:
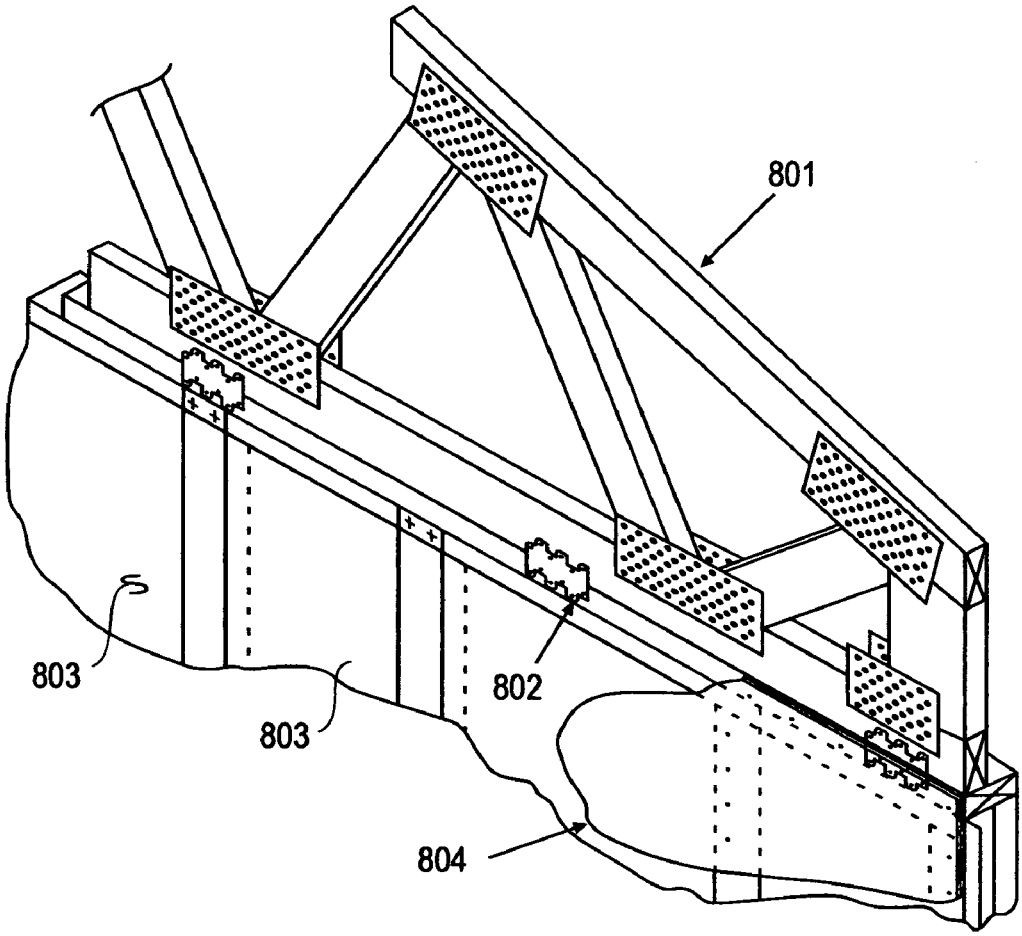
FIG. 8 illustrates a drag truss at a panel in a particular embodiment.

FIG. 8 illustrates a drag truss at a panel in a particular embodiment. A drag truss 801 is shown. A conventional plate 802 is shown. A panel 803 is shown. A shearwall sheathing 804 is shown.

Figure 9B:
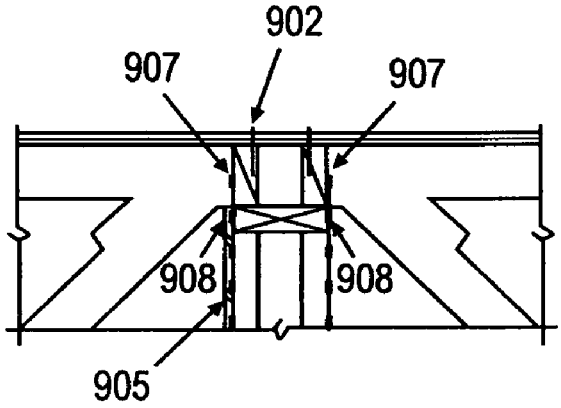
FIGS. 9A and 9B illustrate a wood truss at an interior panel in a particular embodiment.
Figure 9A:
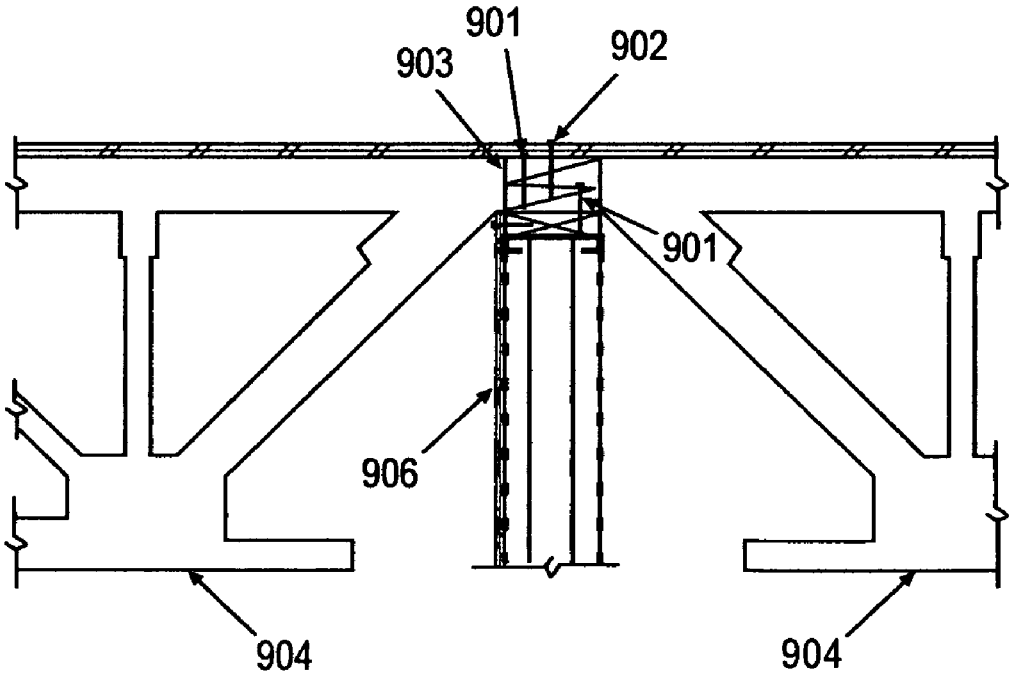

FIGS. 9A and 9B illustrate a wood truss at an interior panel in a particular embodiment. An edge nailing 902 is shown. A block 903 is shown. A top chord bearing truss 904 is shown. A wall panel 905 is shown. A shearwall sheathing 906 is shown. A block 907 is shown.

Figure 10:
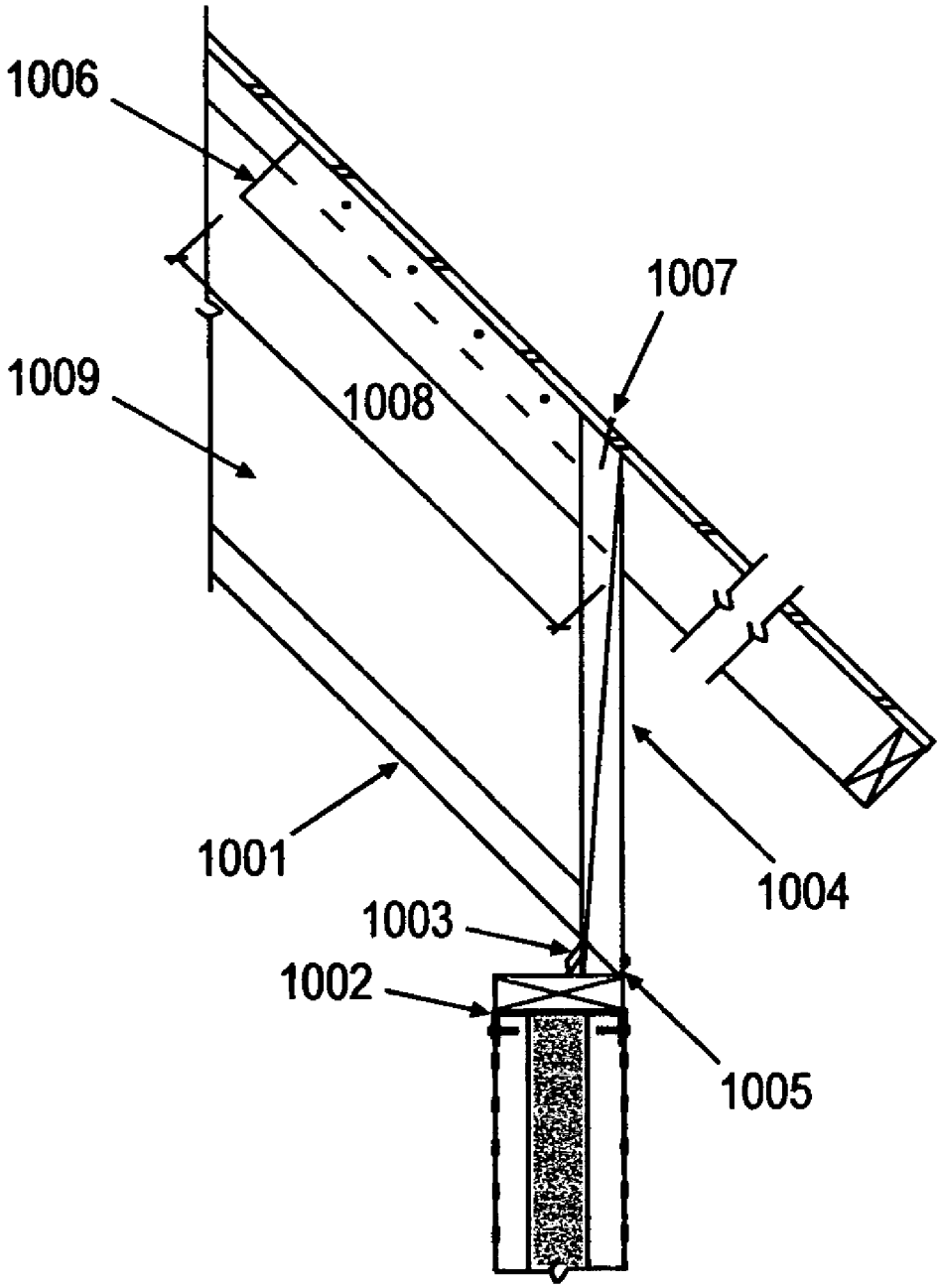
FIG. 10 illustrates a plywood web joist at a wall panel in a particular embodiment.

FIG. 10 illustrates a plywood web joist at a wall panel in a particular embodiment. A plywood web joist 1001 is shown. A panel and top track 1002 is shown. A variable pitch connector 1003 is shown. A top plate blocking 1005 is shown.

Figure 11:
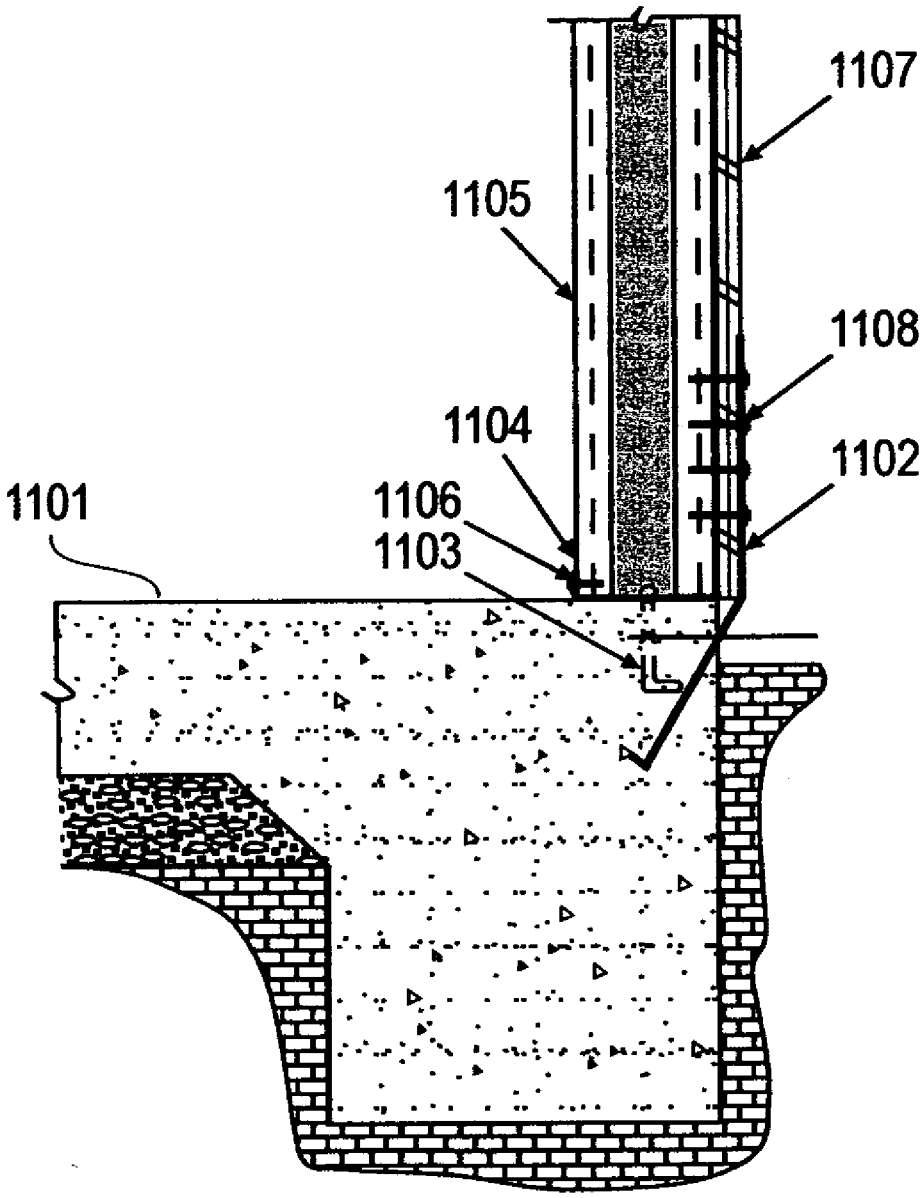
FIG. 11 illustrates an exterior strap holdown at a panel wall in a particular embodiment.

FIG. 11 illustrates an exterior strap holdown at a panel wall in a particular embodiment. A concrete slab or foundation 1101 is shown. A strap holdown 1102 is shown. A track anchorage 1103 is shown. A bottom track 1104 is shown. A panel stud 1105 is shown. Screws 1106 are shown. Exterior sheathing 1107 is shown. Screws 1108 embedded in sheathing 1107 and stud 1105 is also shown.

Figure 12B:
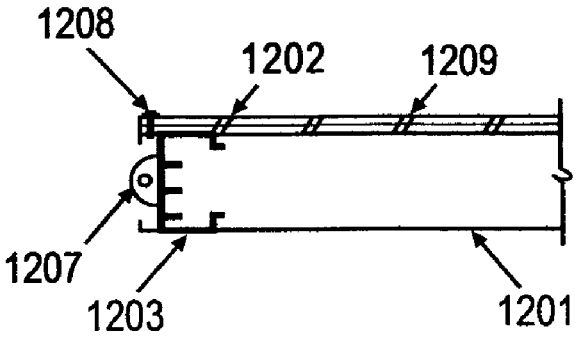
FIGS. 12A and 12B illustrate an interior wall with holdown in a particular embodiment.
Figure 12A:
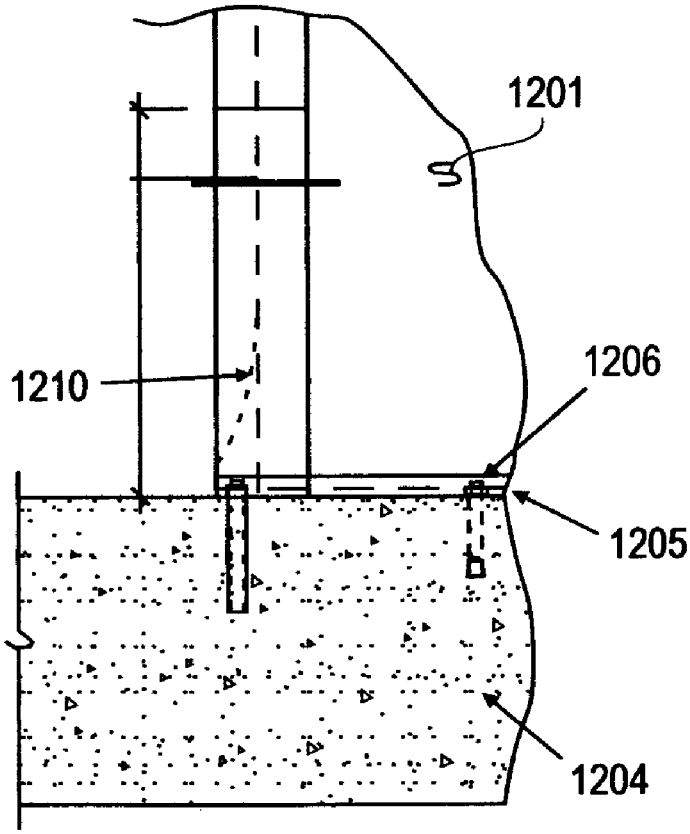

FIGS. 12A and 12B illustrate an interior wall with holdown in a particular embodiment. A panel 1201 is shown. The 3-bend members 1202 and 1203 are shown. A concrete slab 1204 is shown. A panel bottom track 1205 is shown. A track anchorage 1206 is shown. A C-stud 1207 is shown. Screws 1208 are shown. Interior sheathing 1209 is shown. A holdown 1210 is shown.

The new panel configuration of a 4-bend hat channel stud embedded in EPS substantially improves the vertical load carrying capacity of the embedded stud columns; because, the EPS acts to create a continuously braced column, which has much better load-bearing capacity. This improvement in load bearing capacity does not require connecting members between studs or a 6-bend stud.

An additional advantage of the disclosed panel of various embodiments is that the panel can use the expansive nature of the adhesive. The panels can be joined together and screwed with a lap as detailed above in connection with the drawings. As the glue sets, it attempts to force the panels apart putting the connection in tension. This tension minimizes the hinging that is seen between the panels allowing for beam action top to bottom and side to side. A simple example of this is a two way floor slab. A two way floor slab has reinforcement running in both directions and has multiples more load carrying capacity. The disclosed panel of various embodiments will make terrific floor and roof panels that will require far less beam support thereby making them much more efficient to use in these applications as well.

An additional advantage of the disclosed panel of various embodiments involves the lap at the ends. Here, in particular embodiments, a two and two with third field bend hats can be used. This makes all panels (save the electrical and plumbing chases) interchangeable. Having all panels interchangeable is highly advantageous as it makes the necessity for detailed shop drawings obsolete thereby saving time and cost.

An additional advantage of the disclosed panel of various embodiments involves the manner in which interior panels are anchored with post install hold downs as described above in connection with the figures. Having the ability to move a wall and not be concerned with being a couple of inches off could save a great deal in on-site labor and potential work stoppage.

The interaction between the studs and the panel can rely on friction. This action will be amplified once sheathing is added. The compression between the studs, as provided in conventional panel designs (e.g. the Onken patent application), is not necessary when there is enough friction between the channels and the studs to resist the shear that occurs when the panel is in bending. One additional advantage of having the studs embedded into the foam is that the foam is rigid enough to fully brace the flanges of the studs. In absence of the foam, the capacity in bending of the section is limited by local buckling of the flanges and is multiples less than having the flanges fully braced. In a similar fashion, the vertical load carrying capacity of the embedded stud columns is substantially increased as a continuously braced column depending on length and gauge.

An additional advantage of the disclosed panel of various embodiments is that the steel and the expanded polystyrene foam do not release off-gassing from resins, adhesives or chemicals normally used for wood construction. This creates less toxic residue at the manufacturing and building site.

An additional advantage of the disclosed panel of various embodiments is that the panels are fast and easy to install. Anyone can be trained in the site installation of the walls and roofs in just hours—not days, weeks or months. Thus, construction time is shorter and less expensive.

An additional advantage of the disclosed panel of various embodiments is that the panels are resistant to fire, natural disasters, earthquakes, hurricanes, mold, mildew, moisture, insects, rust, and warping. The panels provide diminished air pollutants and dust. Further, the panels are substantially stronger than wood panels and made from 100% recyclable non-toxic materials.

Figure 13A:
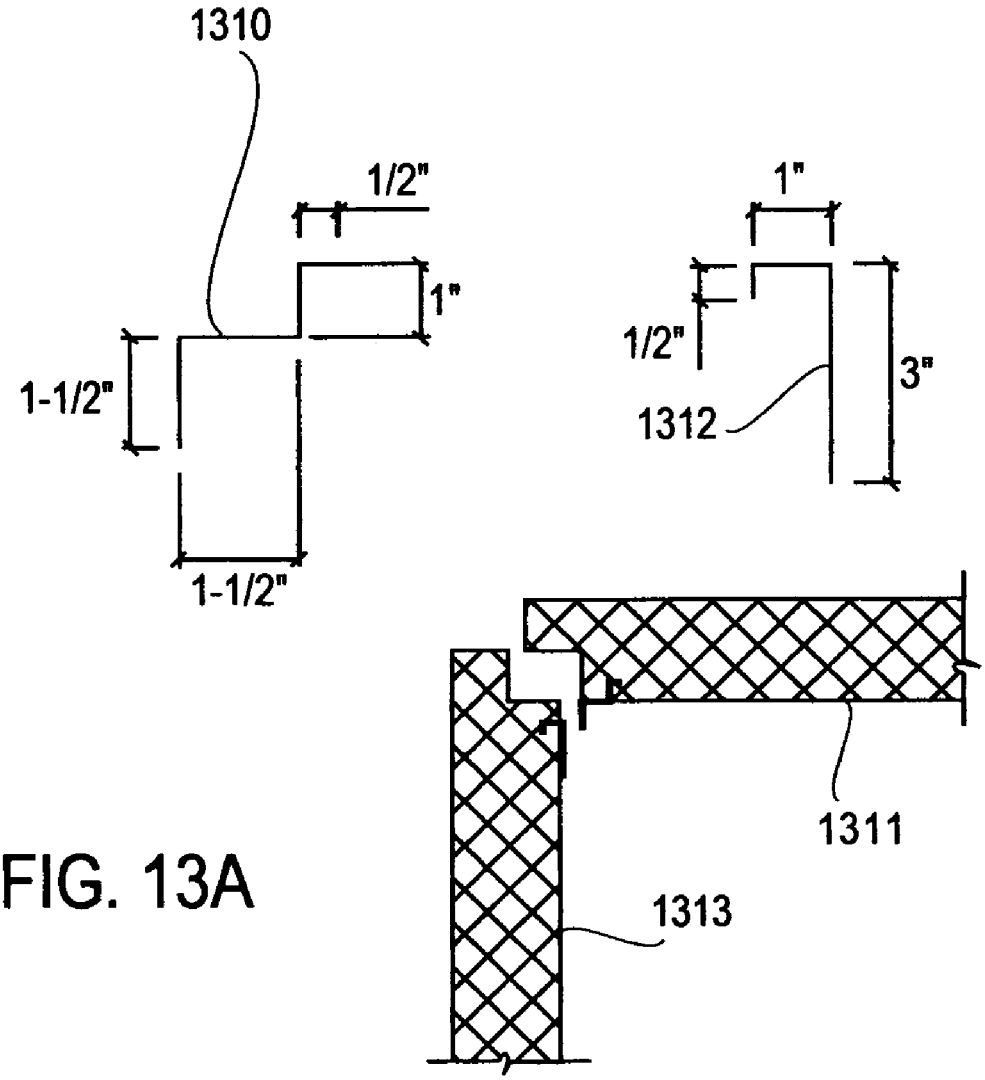
FIGS. 13A-16 illustrate an example embodiment of an inner corner joint and an outer corner joint in a particular embodiment.

Referring to FIGS. 13A-16 illustrate an example embodiment of an inner corner joint and an outer corner joint. FIG. 13A illustrates an inner corner joint comprising two components, a first inner corner joint component 1310 and a second inner corner joint component 1312. As shown in FIG. 13A, first inner corner joint component 1310 is inserted or formed into an insulated panel 1311 at an inside corner of the insulated panel 1311. Similarly, as shown in FIG. 13A, second inner corner joint component 1312 is inserted or formed into an insulated panel 1313 at an inside corner of the insulated panel 1313. In this manner, a flat face of first inner corner joint component 1310 can be made flush with a flat face of second inner corner joint component 1312 when insulated panels 1311 and 1313 are joined at the corners at right angles as shown in FIG. 13A. When the flat face of first inner corner joint component 1310 is flush with the flat face of second inner corner joint component 1312, the first inner corner joint component 1310 can be bonded to second inner corner joint component 1312 using a variety of means including, the use of bolts, screws, welds, glue, and the like. When first inner corner joint component 1310 is so bonded to second inner corner joint component 1312, the inventive inner corner joint serves to securely hold the insulated panels 1311 and 1313 in a right angle alignment.

Figure 15:
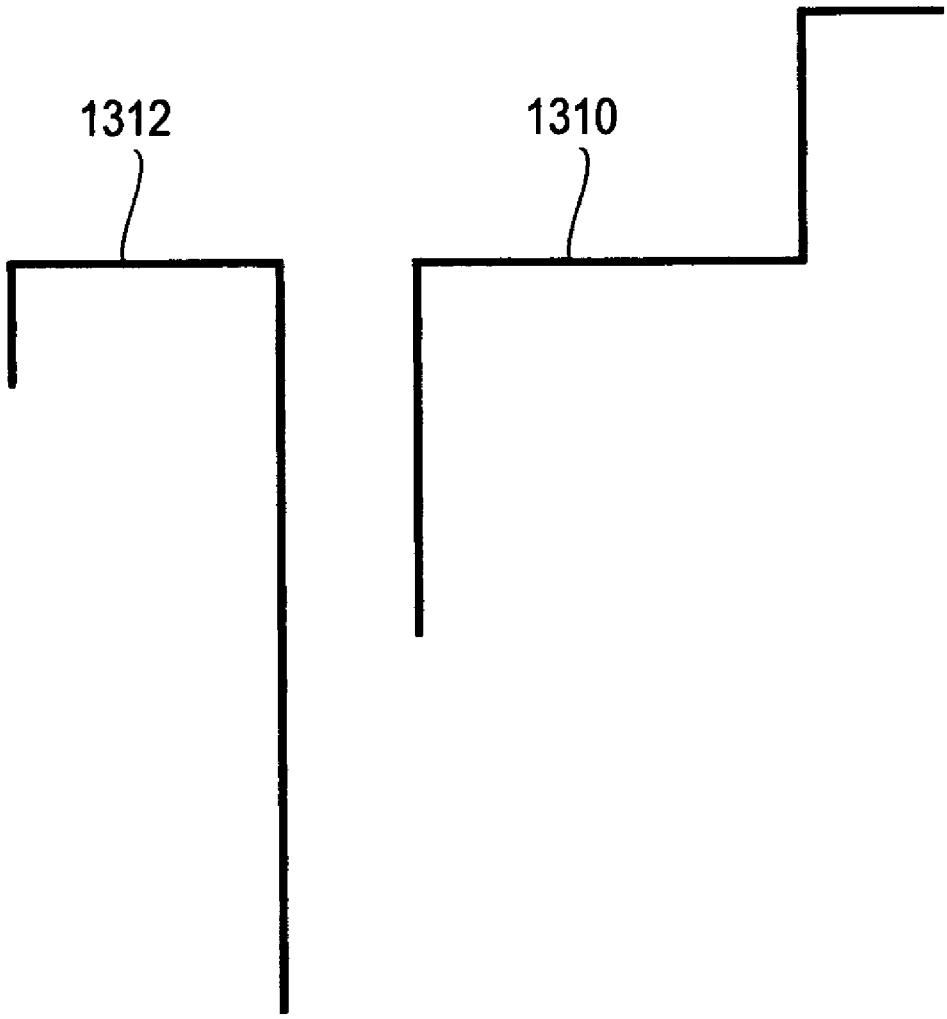

FIG. 15 illustrates a detail of the first inner corner joint component 1310 and the second inner corner joint component 1312. These components can be fabricated from a variety of rigid materials including metal, composites, wood, and the like.

Figure 13B:
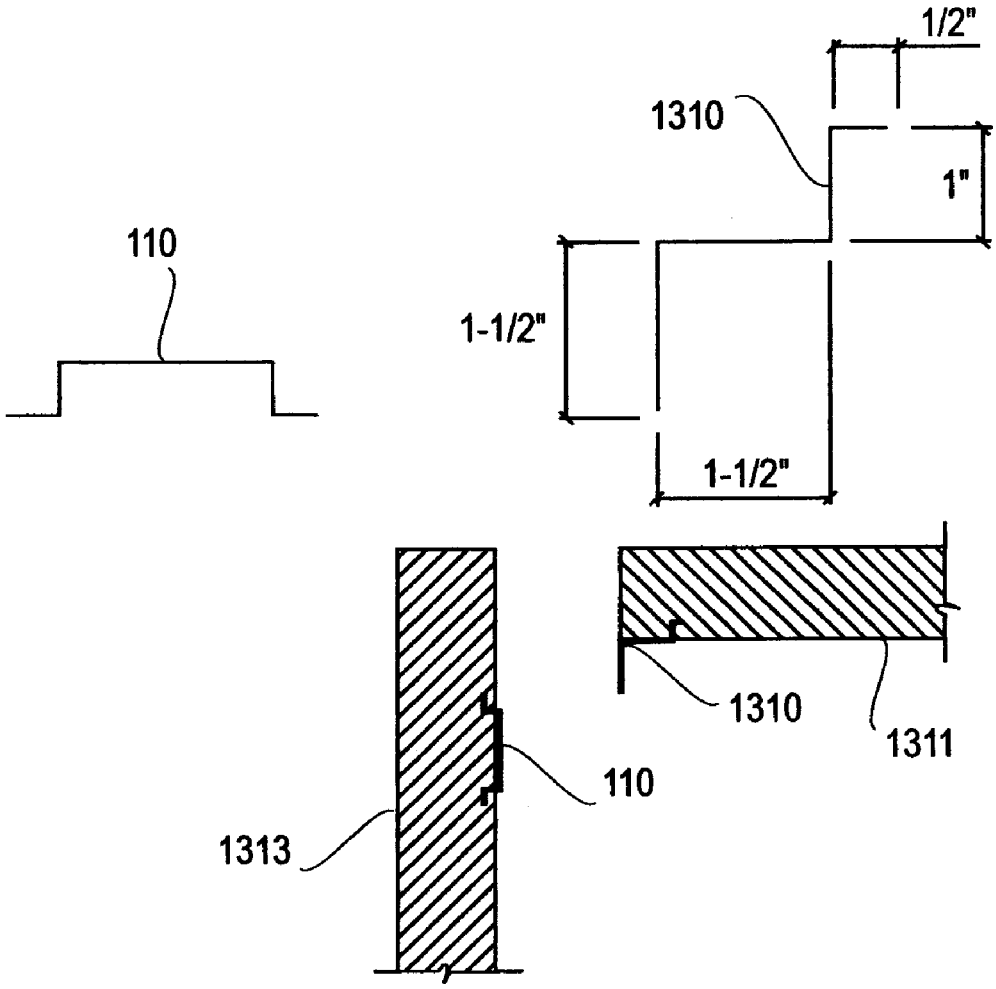

FIG. 13B illustrates another embodiment of an inner corner joint comprising a single join component 1310 and a stud 110. As shown in FIG. 13B, join component 1310 is inserted or formed into an insulated panel 1311 at an inside corner of the insulated panel 1311. Similarly, as shown in FIG. 13B, stud 110 is inserted or formed into an insulated panel 1313 at an inside surface of the insulated panel 1313. In this manner, a flat face of the join component 1310 can be made flush with a flat face of stud 110 when insulated panels 1311 and 1313 are joined at as shown in FIG. 13B. When the flat face of the join component 1310 is flush with the flat face of stud 110, the join component 1310 can be bonded to stud 110 using a variety of means including, the use of bolts, screws, welds, glue, and the like. When join component 1310 is so bonded to stud 110, the inventive inner corner joint serves to securely hold the insulated panels 1311 and 1313 in a right angle alignment.

Figure 14A:
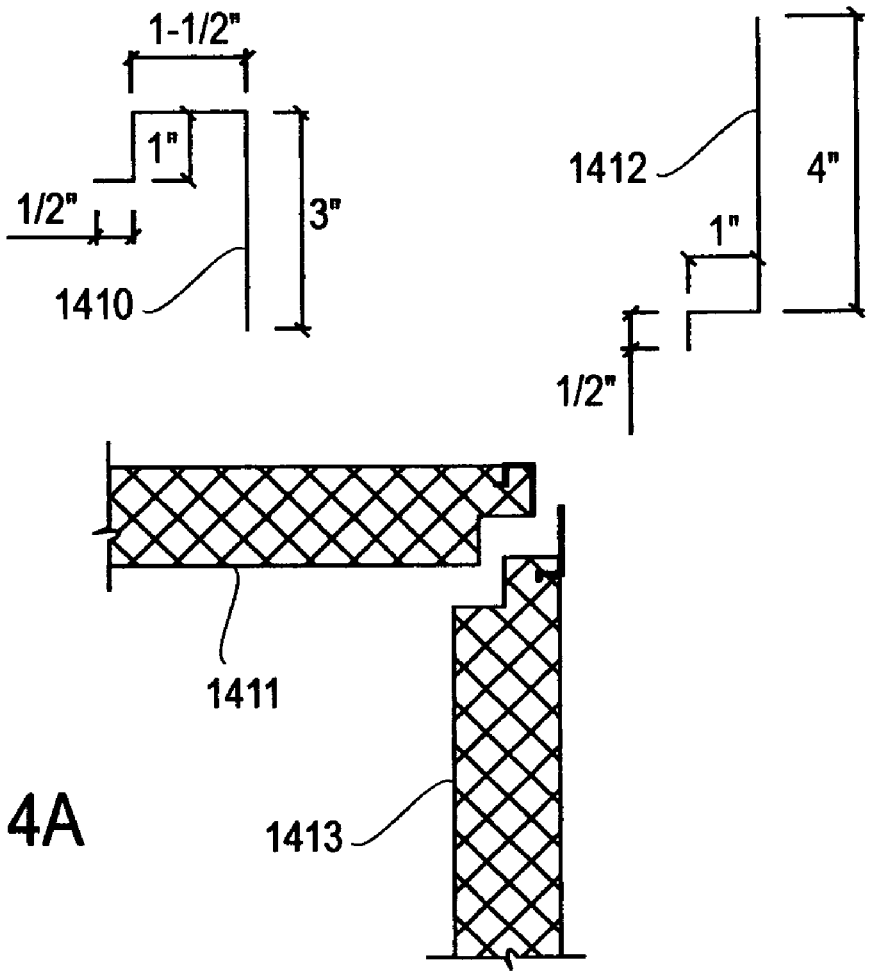

FIG. 14A illustrates an outer corner joint comprising two components, a first outer corner joint component 1410 and a second outer corner joint component 1412. As shown in FIG. 14A, first outer corner joint component 1410 is inserted or formed into an insulated panel 1411 at an outside corner of the insulated panel 1411. Similarly, as shown in FIG. 14A, second outer corner joint component 1412 is inserted or formed into an insulated panel 1413 at an outside corner of the insulated panel 1413. In this manner, a flat face of first outer corner joint component 1410 can be made flush with a flat face of second outer corner joint component 1412 when insulated panels 1411 and 1413 are joined at the corners at right angles as shown in FIG. 14A. When the flat face of first outer corner joint component 1410 is flush with the flat face of second outer corner joint component 1412, the first outer corner joint component 1410 can be bonded to second outer corner joint component 1412 using a variety of means including, the use of bolts, screws, welds, glue, and the like. When first outer corner joint component 1410 is so bonded to second outer corner joint component 1412, the inventive outer corner joint serves to securely hold the insulated panels 1411 and 1413 in a right angle alignment.

Figure 16:
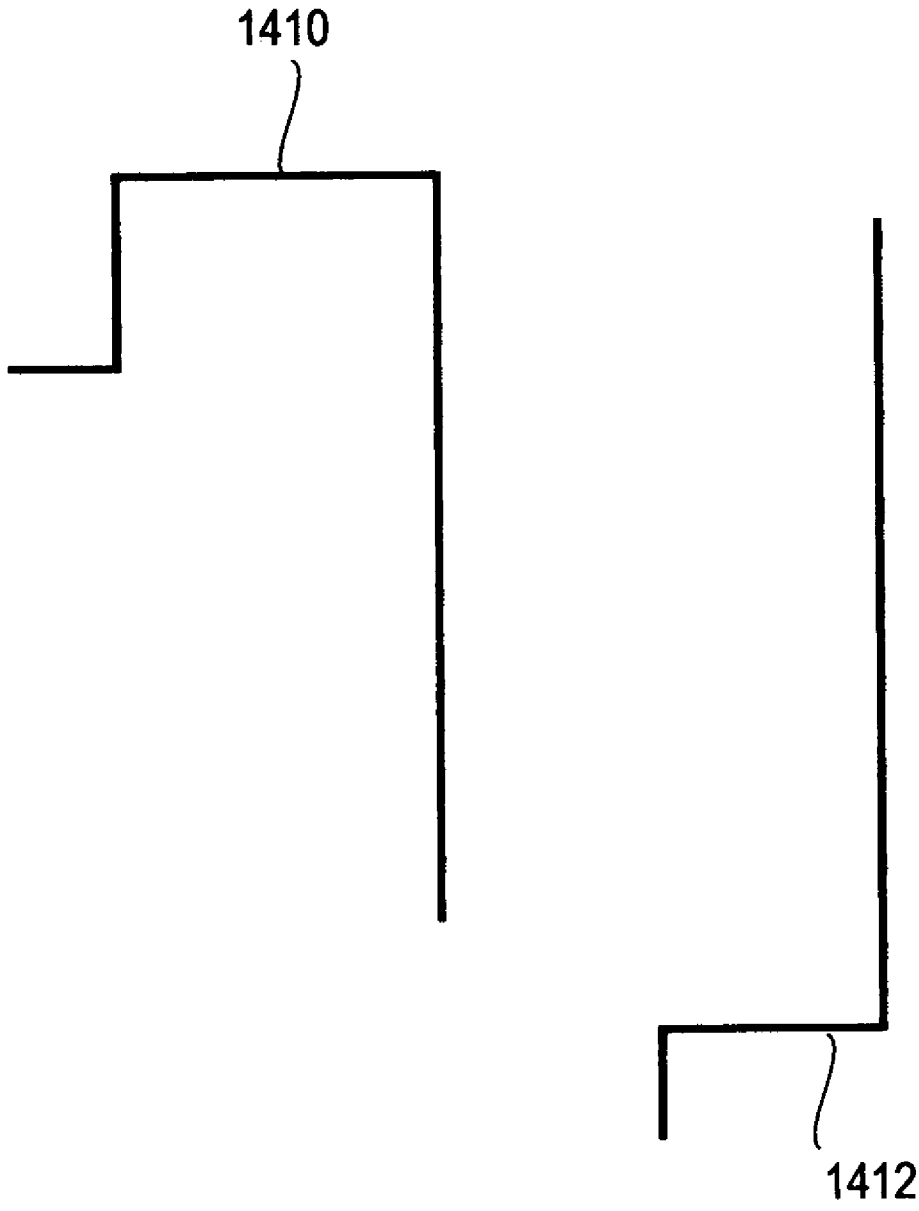

FIG. 16 illustrates a detail of the first outer corner joint component 1410 and the second outer corner joint component 1412. These components can be fabricated from a variety of rigid materials including metal, composites, wood, and the like.

Figure 14B:
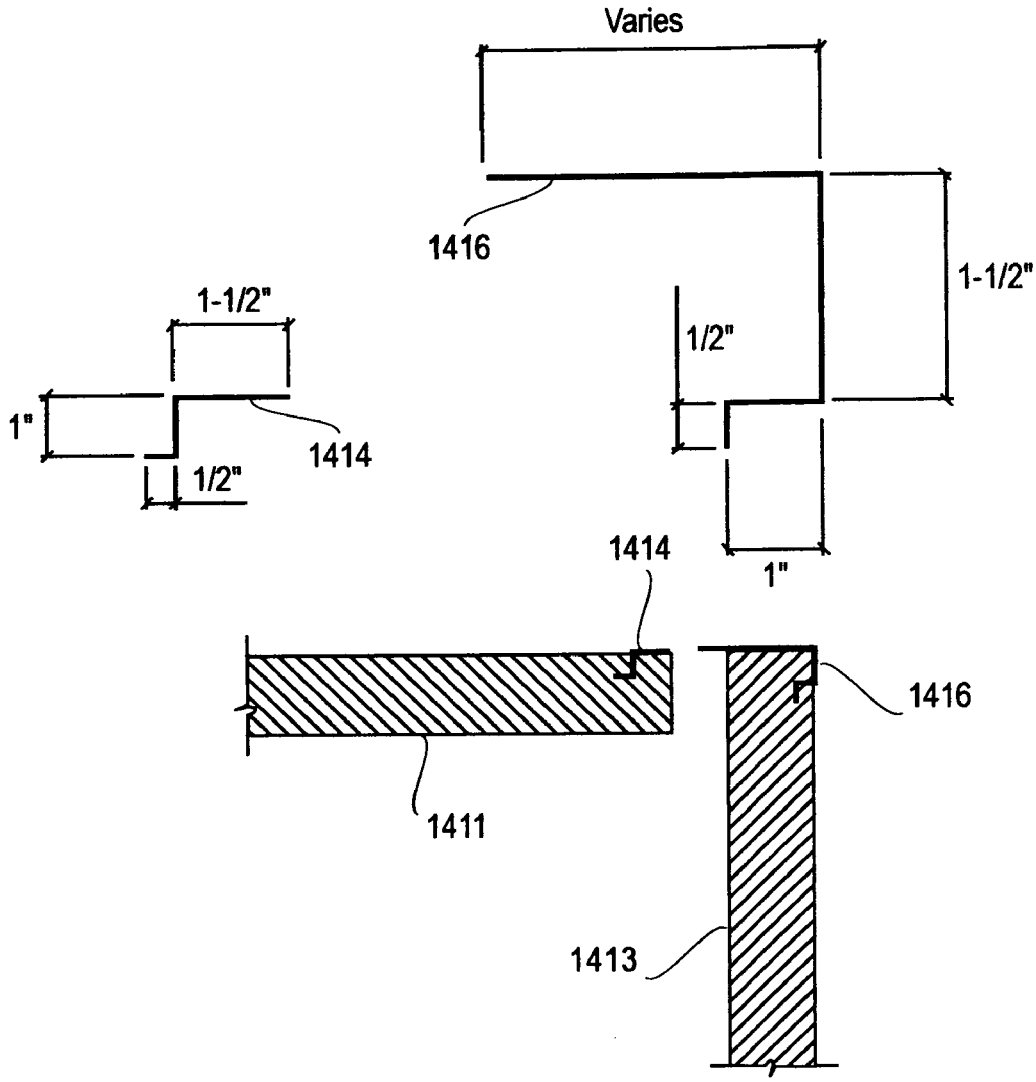

FIG. 14B illustrates an alternative embodiment of an outer corner joint comprising two components, a first outer corner joint component 1414 and a second outer corner joint component 1416. As shown in FIG. 14B, first outer corner joint component 1414 is inserted or formed into an insulated panel 1411 at an outside corner of the insulated panel 1411. Similarly, as shown in FIG. 14B, second outer corner joint component 1416 is inserted or formed into an insulated panel 1413 at an outside corner and across an edge of the insulated panel 1413. In this manner, a flat face of first outer corner joint component 1414 can be made flush with a flat face of second outer corner joint component 1416 when insulated panels 1411 and 1413 are joined at the corners at right angles as shown in FIG. 14B. When the flat face of first outer corner joint component 1414 is flush with the flat face of second outer corner joint component 1416, the first outer corner joint component 1414 can be bonded to second outer corner joint component 1416 using a variety of means including, the use of bolts, screws, welds, glue, and the like. When first outer corner joint component 1414 is so bonded to second outer corner joint component 1416, the inventive outer corner joint serves to securely hold the insulated panels 1411 and 1413 in a right angle alignment.

Figure 17:
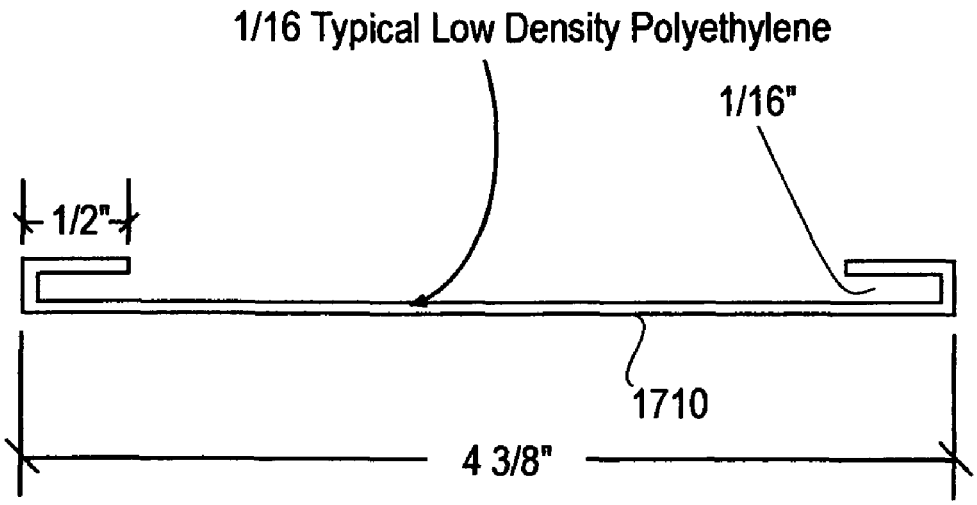
FIG. 17 illustrates a plastic clip used to facilitate the insertion of studs, wiring, plumbing and the like into channels cut into the foam core of a panel.

FIG. 17 illustrates a plastic clip 1710 used to facilitate the insertion of studs, wiring, plumbing and the like into channels cut into the foam core of a structural insulated panel. As shown, the clip 1710, typically fabricated from a polyethylene material, is formed in a shape that can be inserted into a channel in the foam core of a structural insulated panel. A metal stud, brace member, wiring, or plumbing component can then more easily be inserted into the foam core of the structural insulated panel.

Figure 18:
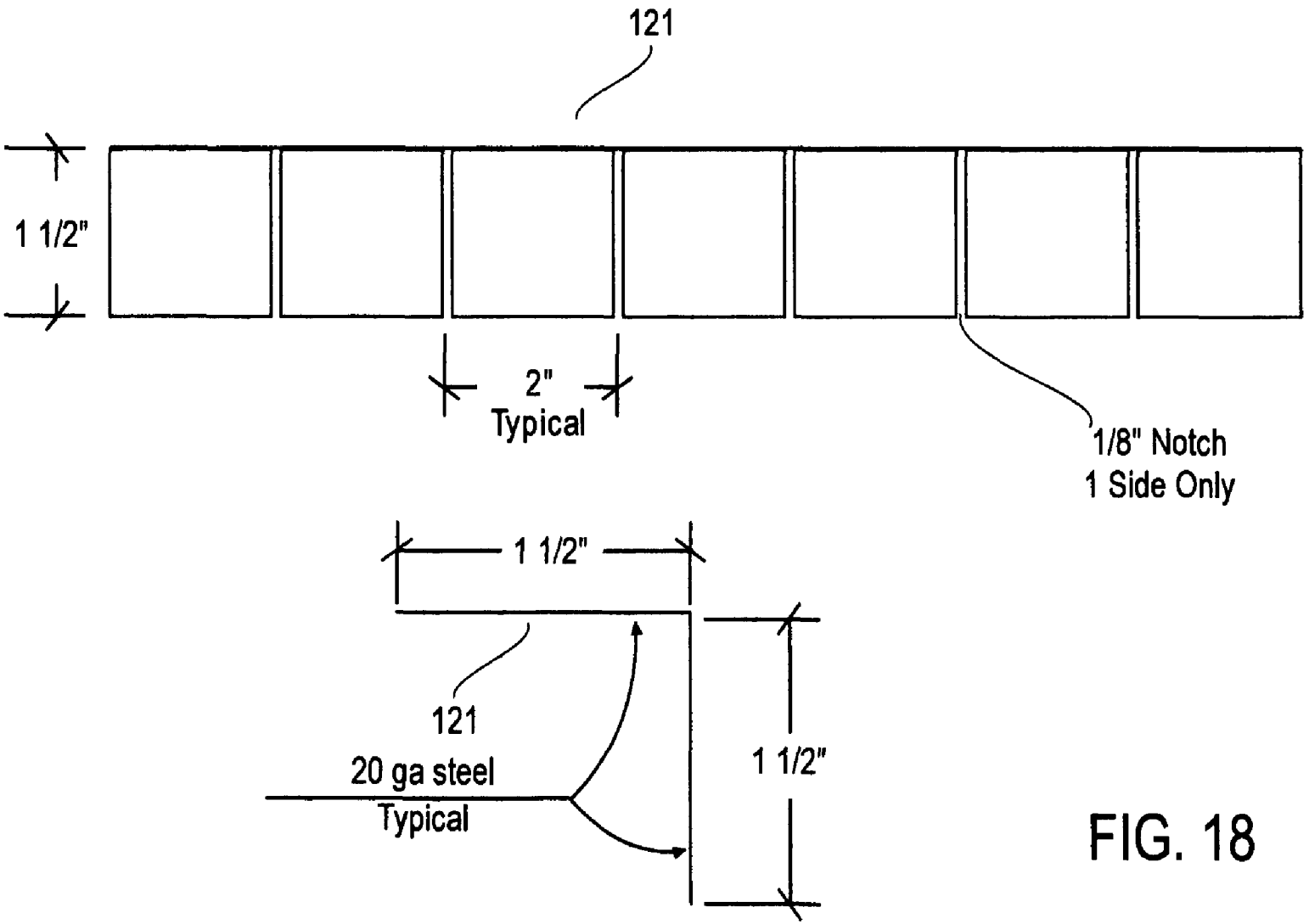
FIG. 18 illustrates the particular structure of the curved angle braces used with the curved panel in an example embodiment.

Referring back to FIG. 3, a curved panel 101 is illustrated with studs 110, angle braces 120, and rigid foam core 115. FIG. 18 illustrates the particular structure of the curved angle braces 121 used with the curved panel 101. Because the curved angle braces 121 must follow and be flush with the inner and outer curved surfaces of curved panel 101, the curved angle braces 121 of one embodiment are notched at several locations as shown in FIG. 18 to enable bending of the rigid curved angle braces 121 without warping. The spacing and width of each notch can be varied depending on the needed level of curve.

Figure 19:
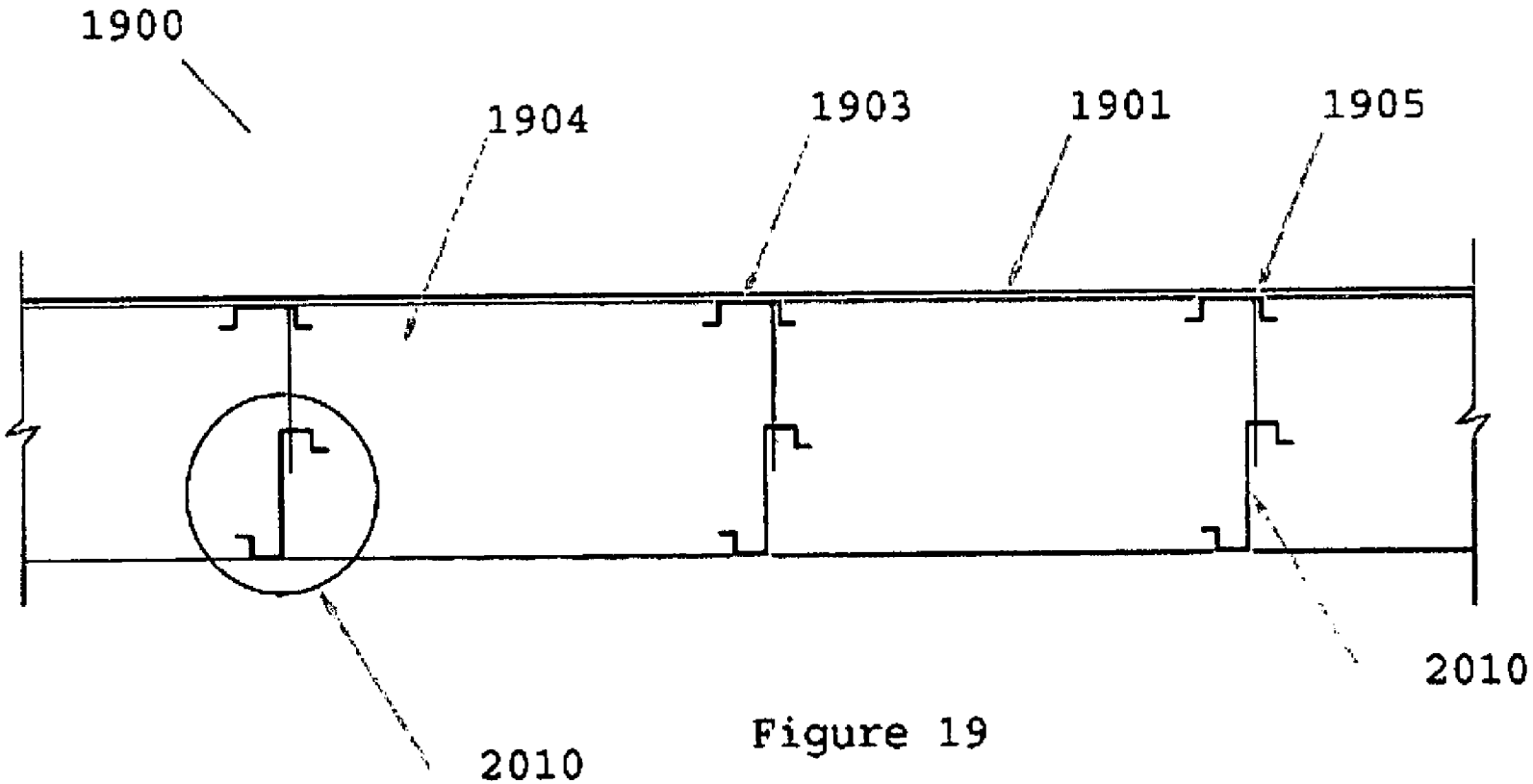
FIG. 19 is a cutaway cross-section diagram illustrating an insulated roof panel according to an example embodiment.

Referring to FIG. 19, a cutaway cross-section diagram (cut perpendicularly to the embedded supports) illustrates an insulated roof panel 1900 comprising an expanded polystyrene foam (EPS) core 1904 with two types of embedded supports or joists. A first type of embedded support 1903 is configured like the 4-bend metal hat channel stud described above, except that the support 1903 is inserted laterally and parallel to the outer surface of the roof panel on which roof sheathing (e.g. plywood) 1901 may be applied. As described above, a particular embodiment of support 1903 is a rigid (e.g. metal) 4-bend support that can be inserted into a channel cut into the foam core 1904. A plurality of supports 1903 can be inserted into foam core 1904 at regular distances of separation as shown in FIG. 19. Each support 1903 is embedded in the foam core 1904 so that only a single outer face of the support 1903 is substantially flush with the outer surface of foam core 1904. A second type of embedded support 2010 is configured, in a particular embodiment, as a 6-bend metal channel joist as shown in the cross-section detail in FIG. 20. The support 2010 is also inserted laterally and parallel to the outer surface of the roof panel on which roof sheathing (e.g. plywood) 1901 may be applied. Support 2010 is a rigid (e.g. metal) support that can be inserted into a channel cut into the foam core 1904. A plurality of supports 2010 can be inserted into foam core 1904 at regular distances of separation as shown in FIG. 19. Each support 2010 is embedded in the foam core 1904 so that only a single outer face of the support 2010 is substantially flush with the inner surface of foam core 1904. Support 2010 is configured with six bends to provide a high degree of resilience to compressive and shearing forces. For added strength, a Teks screw 1905, such as a ¼-28×8" screw, can be used to connect the support 1903 to support 2010 as shown in FIG. 19. In this manner, compressive and shearing forces can be transferred between supports 1903 and 2010 thereby increasing the overall strength of the roof panel 1900. Screws can be used to apply an sheathing to the exterior and interior surfaces of the panel 1900.

Figure 20:
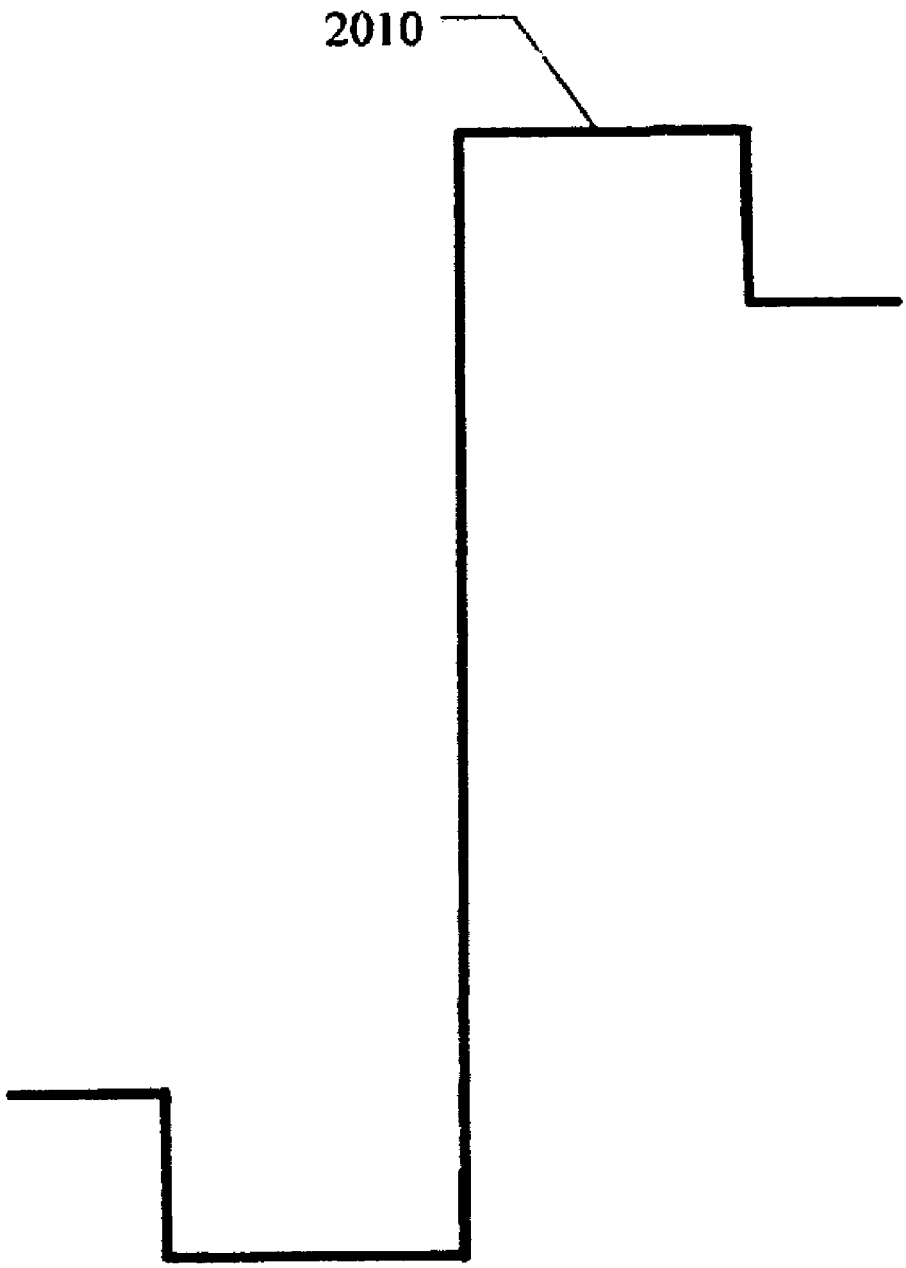
FIG. 20 illustrates a detail view of the 6-bend metal channel support or joist of a particular embodiment.

FIG. 20 illustrates a detail view of the 6-bend metal channel support or joist 2010 of a particular embodiment. Support 2010 is a rigid (e.g. metal) support that can be inserted into a channel cut into the foam core 1904. As described above, support 2010 is configured with six bends in a particular embodiment to provide a high degree of resilience to compressive and shearing forces. It will be apparent to those of ordinary skill in the art that a support with a different number of bends could also be used. Similarly, a support 2010 of various dimensions relative to the thickness of the foam core 1904 could also be used. Further, a support 2010 with bends at angles other than 90 degree bends could also be used.

Figure 21:
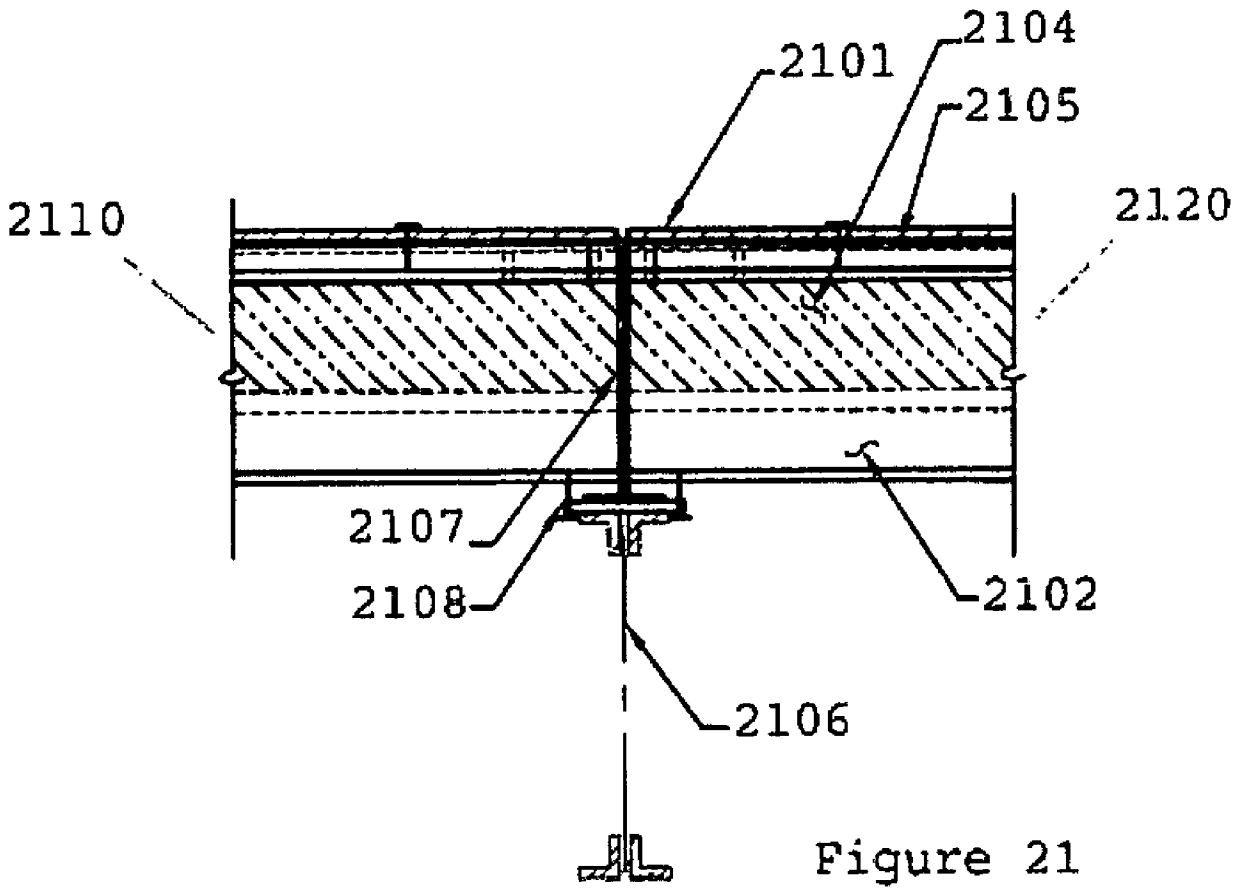
FIG. 21 illustrates an example of an assembly of two structural insulated roof panels with rigid foam cores as joined at a building truss in a particular embodiment.

FIG. 21 illustrates an example of an assembly of two structural insulated roof panels with rigid foam cores as joined at a building truss in a particular embodiment. In the example shown, the ends of two structural insulated roof panels 2110 and 2120 meet at a top surface of a building truss 2106. The end of first support 2105 and the end of second support 2102 of each structural insulated roof panel (2110 and 2120) is shown to meet at a continuous steel track 2107 resting on a steel plate 2108 of truss 2106. The rigid foam core 2104 and outer surface sheathing 2101 of each structural insulated roof panel (2110 and 2120) can also meet at the continuous steel track 2107.

Figure 22:
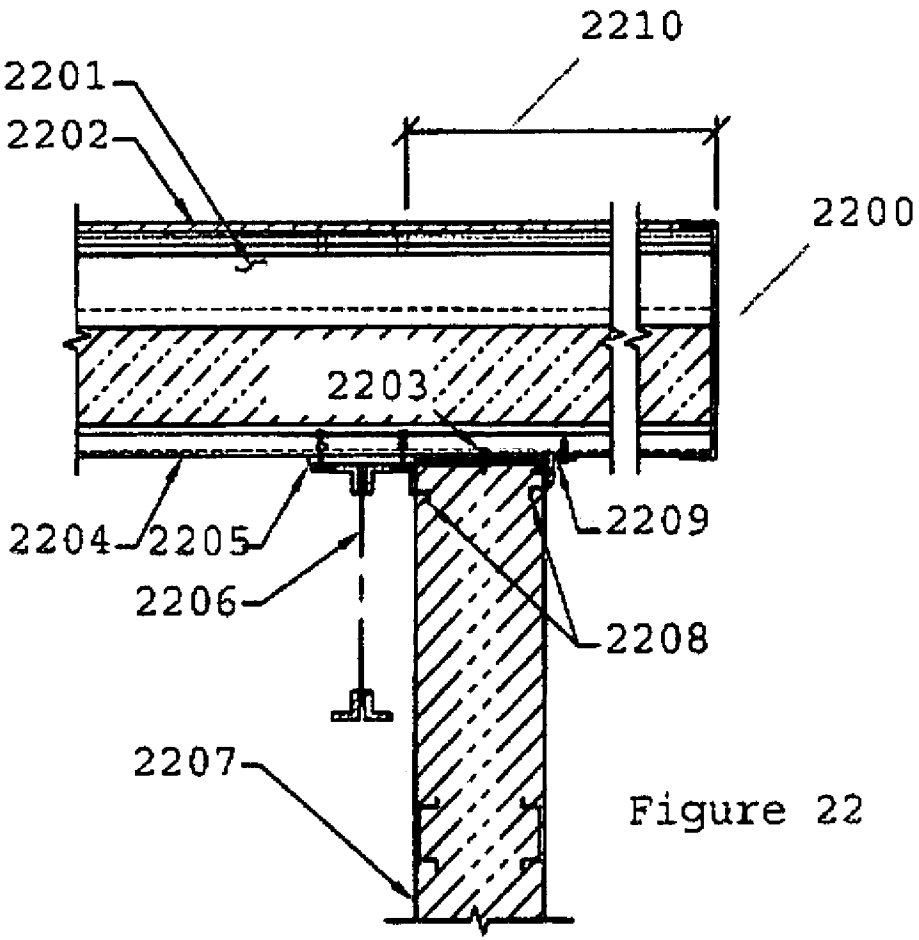
FIG. 22 illustrates an example of an assembly of a cantilevered structural insulated roof panel with a rigid foam core as joined with a structural insulated wall panel with a rigid foam core and configured for a load-bearing condition in a particular embodiment.

FIG. 22 illustrates an example of an assembly of a cantilevered structural insulated roof panel with a rigid foam core as joined with a structural insulated wall panel with a rigid foam core and configured for a load-bearing condition in a particular embodiment. In the example shown, a structural insulated roof panel 2200 is placed in cantilevered fashion on a building truss 2206 adjacent to a structural insulated wall panel 2207. The cantilevered overhang 2210 allows the wall panel 2207 to be protected underneath the roof panel 2200. The loading is carried by the truss 2206, which supports the roof panel 2200. A steel plate 2205 rests on top of the truss 2206 and wall panel 2207 and enables the first support 2204 of roof panel 2200 to be attached to the steel plate 2205 with screws or the like. A 3-bend end cap 2208 can be attached to the top face of the wall panel 2207 to enable the wall panel 2207 to be attached to the steel plate 2205 with screws 2203 or the like. The second support 2201 of roof panel 2200 is adjacent to the upper (outer) face of the roof panel 2200 to which sheathing 2202 may be attached.

Figure 23:
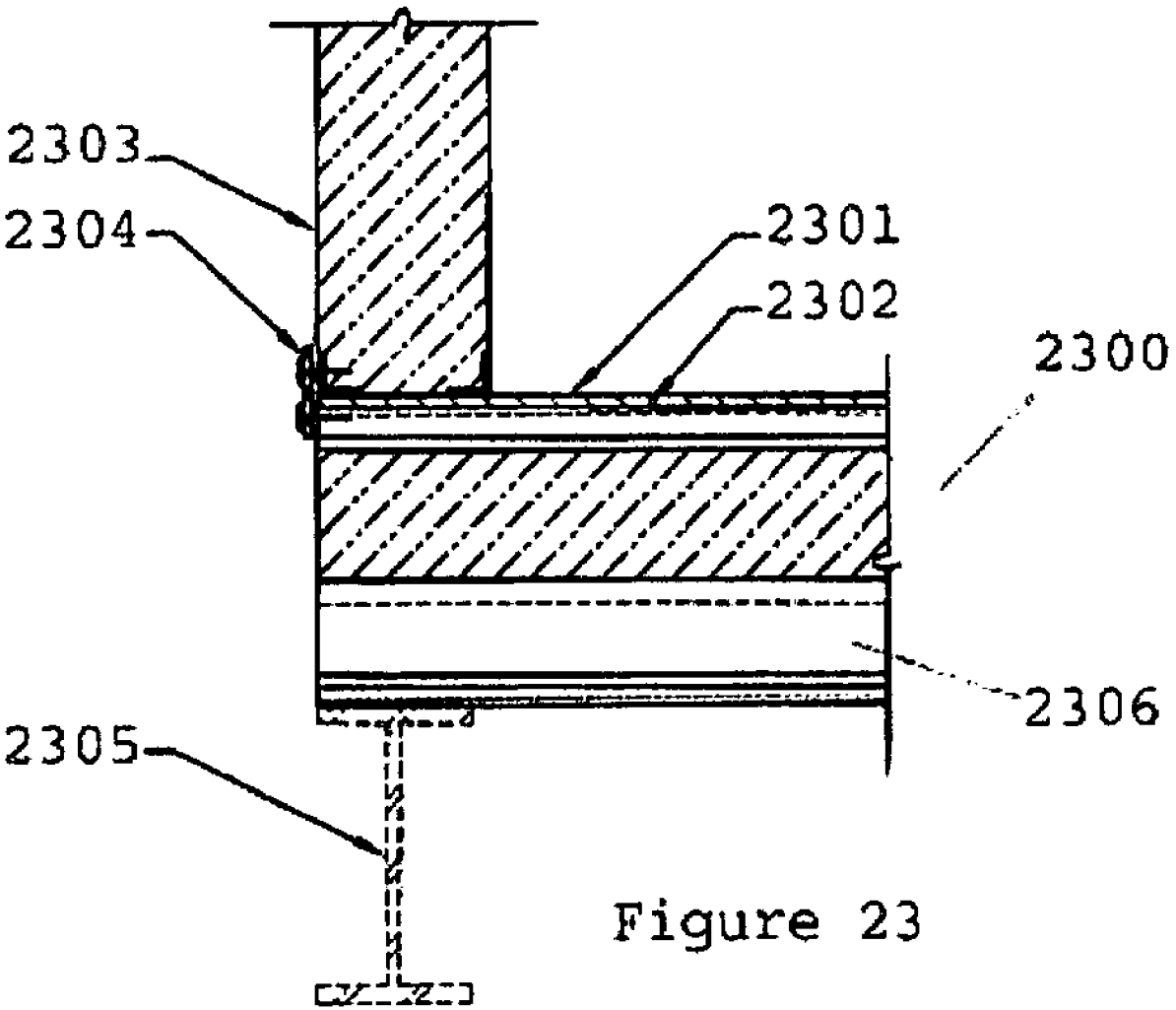
FIG. 23 illustrates an example of an assembly of a structural insulated roof panel with a rigid foam core as joined with a structural insulated wall panel with a rigid foam core and configured for a load-bearing condition in a particular embodiment.

FIG. 23 illustrates an example of an assembly of a structural insulated roof panel with a rigid foam core as joined with a structural insulated wall panel with a rigid foam core and configured for a load-bearing condition in a particular embodiment. In the example shown, a structural insulated roof panel 2300 is placed on a steel beam 2305 adjacent to the second support 2306 of roof panel 2300. A structural insulated wall panel 2303 can be placed on top of the roof sheathing 2301 on the top surface of roof panel 2300. The first support 2302 of roof panel 2300 provides an attach point for wall panel 2303 via a splice plate 2304.

Figure 24:
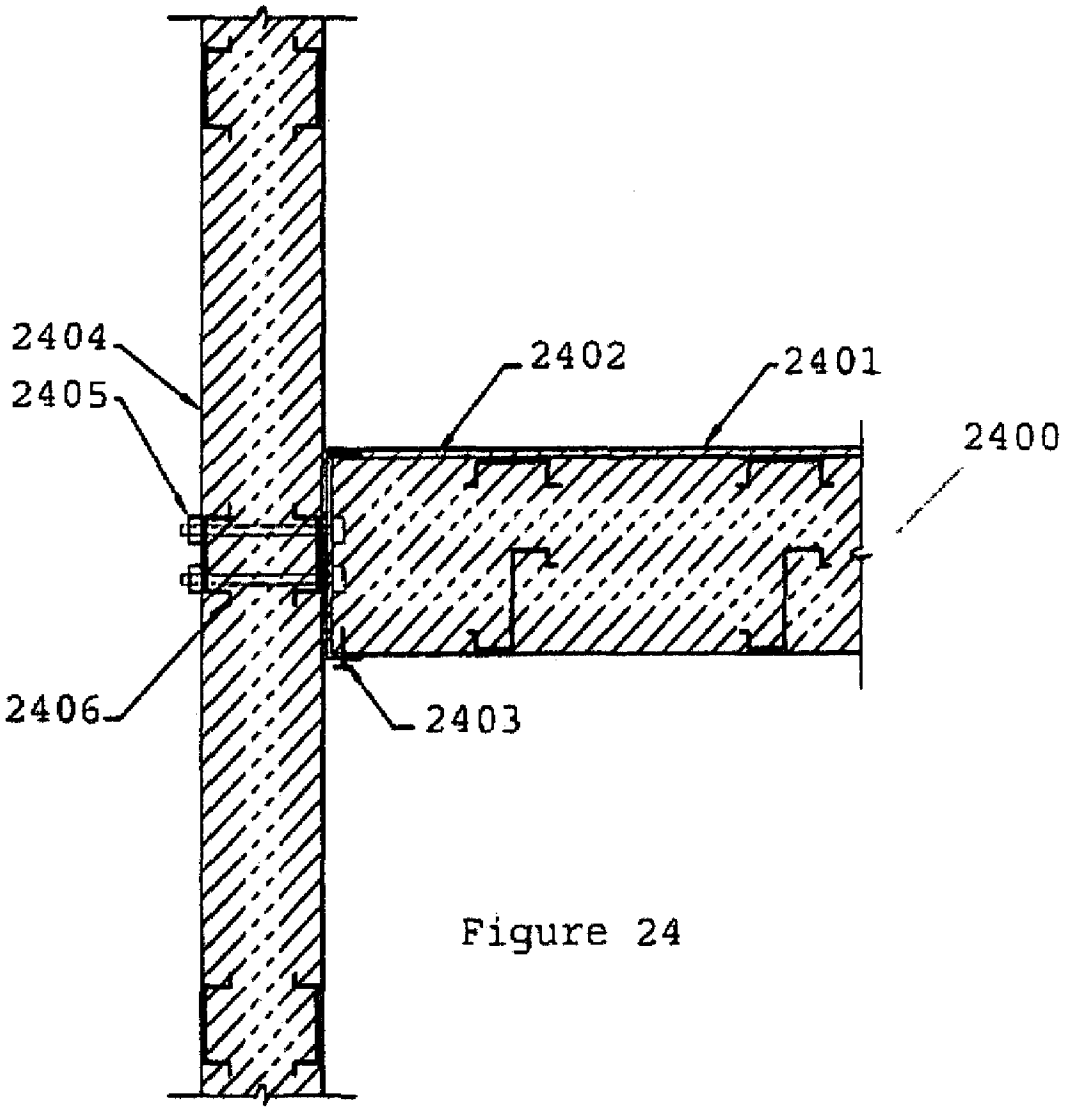
FIG. 24 illustrates an example of an assembly of a structural insulated roof panel with a rigid foam core as joined with a structural insulated wall panel with a rigid foam core and configured for a non-load-bearing condition in a particular embodiment.

FIG. 24 illustrates an example of an assembly of a structural insulated roof panel with a rigid foam core as joined with a structural insulated wall panel with a rigid foam core and configured for a non-load-bearing condition in a particular embodiment. In the example shown, a structural insulated roof panel 2400 is placed perpendicularly to a structural insulated wall panel 2404. An end face of the roof panel 2400 meets the wall panel 2404 at any desired point on the wall panel 2404. A light gage ledger 2403 with screws is used to provide an attach point on the end face of the roof panel 2400. The ledger 2403 can be attached to studs 2406 within the wall panel 2404 using through-bolts 2405.

Figure 25:
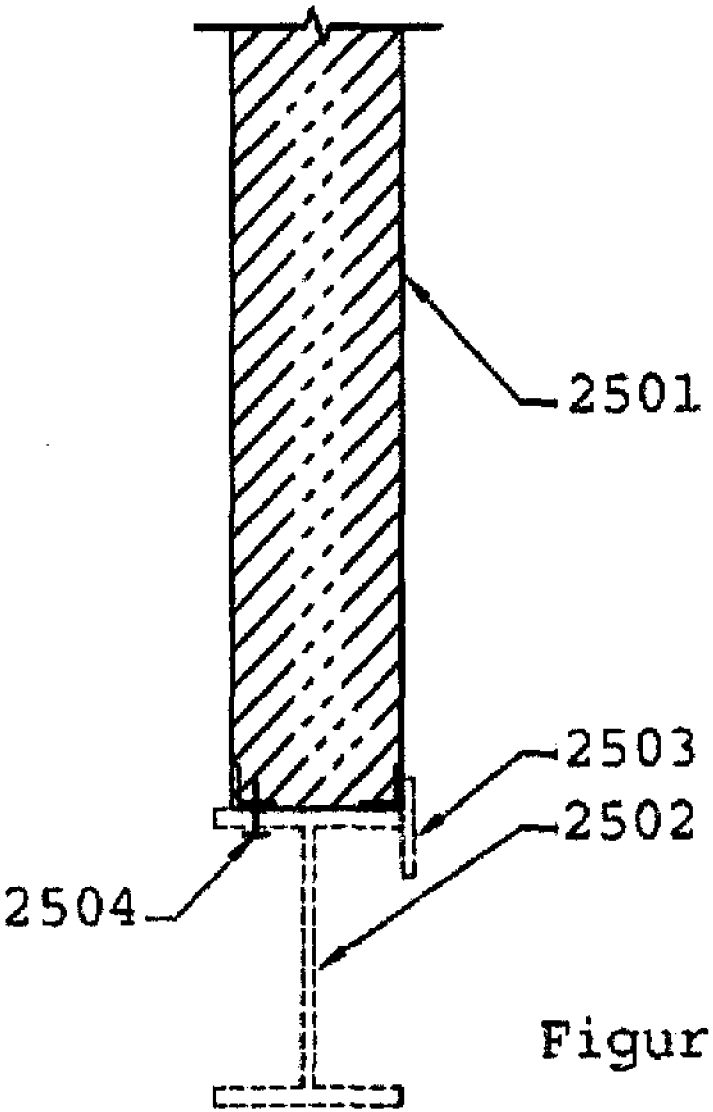
FIG. 25 illustrates an example of an assembly of a structural insulated wall panel with a rigid foam core as joined with a structural beam in a particular embodiment.

FIG. 25 illustrates an example of an assembly of a structural insulated wall panel with a rigid foam core as joined with a structural beam in a particular embodiment. In the example shown, a structural insulated wall panel 2501 is placed on a steel beam 2502 adjacent to a splice plate 2503. The structural insulated wall panel 2501 can be attached to the beam 2502 with screws 2504 or the like.

Figure 26:
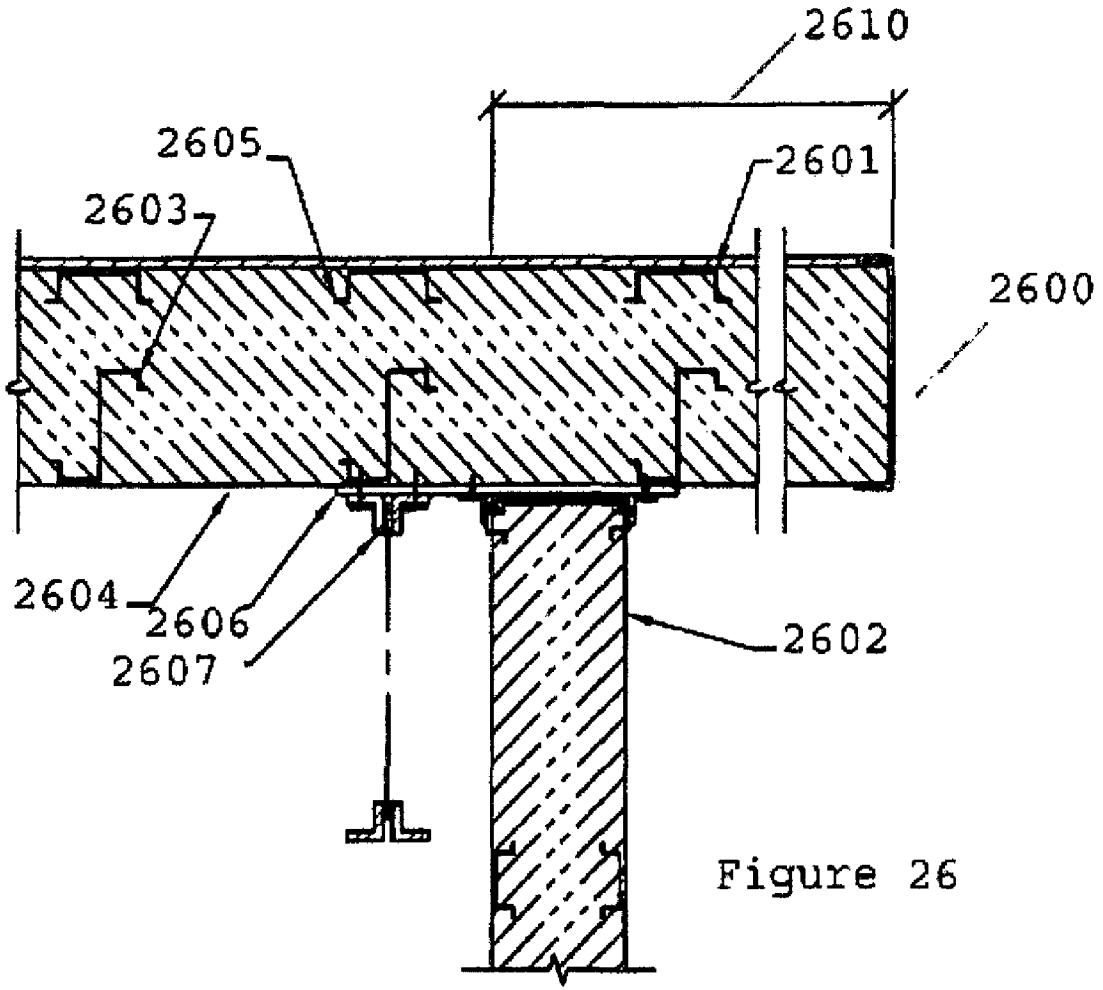
FIG. 26 illustrates an example of an assembly of a cantilevered structural insulated roof panel with a rigid foam core as joined with a structural insulated wall panel with a rigid foam core and configured for a non-load-bearing condition in a particular embodiment.

FIG. 26 illustrates an example of an assembly of a cantilevered structural insulated roof panel with a rigid foam core as joined with a structural insulated wall panel with a rigid foam core and configured for a non-load-bearing condition in a particular embodiment. In the example shown, a structural insulated roof panel 2600 is placed in cantilevered fashion on a building truss 2607 adjacent to a structural insulated wall panel 2602. The cantilevered overhang 2610 allows the wall panel 2602 to be protected underneath the roof panel 2600. The truss 2607 can support the roof panel 2600 in a non-load-bearing capacity. A steel plate 2606 rests on top of the truss 2607 and wall panel 2602 and enables the second support 2603 of roof panel 2600 to be attached to the steel plate 2606 with screws or the like. A 3-bend end cap can be attached to the top face of the wall panel 2602 to enable the wall panel 2602 to be attached to the steel plate 2606 with screws or the like. The first support 2601 of roof panel 2600 is adjacent to the upper (outer) face of the roof panel 2600 to which sheathing may be attached.

Figure 27:
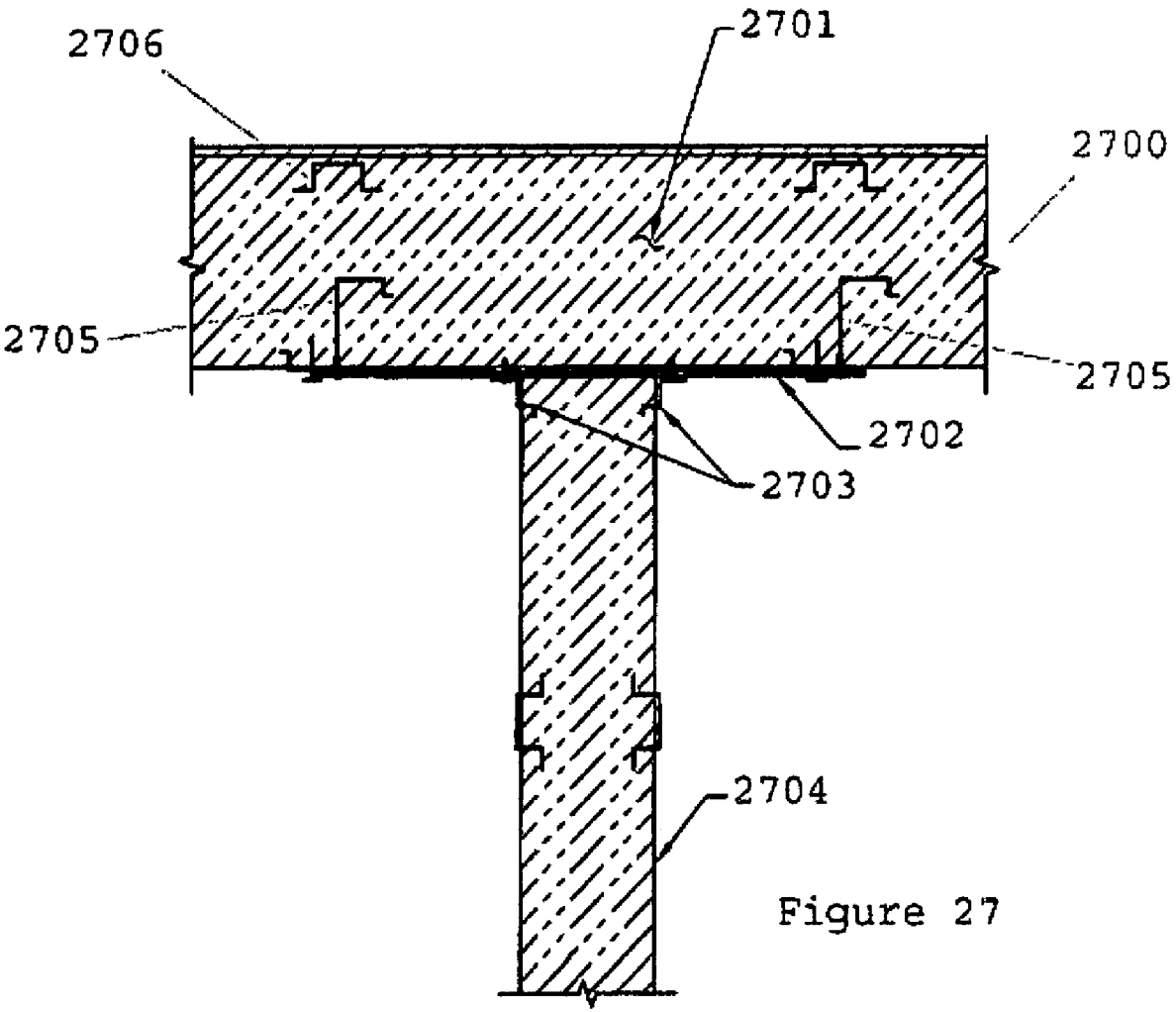
FIG. 27 illustrates an example of an assembly of a structural insulated roof panel with a rigid foam core as joined with a structural insulated wall panel with a rigid foam core in a particular embodiment.

FIG. 27 illustrates an example of an assembly of a structural insulated roof panel with a rigid foam core as joined with a structural insulated wall panel with a rigid foam core in a particular embodiment. In the example shown, a structural insulated roof panel 2700 is joined with a structural insulated wall panel 2704. A sheet metal strap 2702 can be attached to roof panel 2700 with screws between two second supports 2705 of roof panel 2700. Inside corner studs 2703 of wall panel 2704 can be attached to the strap 2702 with screws or the like. The first support 2706 of roof panel 2700 is adjacent to the upper (outer) face of the roof panel 2700 to which sheathing may be attached.

Thus, a structural insulated roof panel with a rigid foam core is disclosed. While the present invention has been described in terms of several example embodiments, those of ordinary skill in the art will recognize that the present invention is not limited to the embodiments described, but can be practiced with modification and alteration within the spirit and scope of the appended claims. The description herein is thus to be regarded as illustrative instead of limiting.

I claim:

1. A method of fabricating a structural insulated roof panel, the method comprising:

forming a plurality of support channels on first and second faces of a rigid foam core, each of the support channels being formed in the rigid foam core as voids cut into the rigid foam core thereby enabling slideable insertion of a support into the void of each support channel, first support channels on the first face of the rigid foam core being formed as voids with two bends and configured to fit corresponding supports having four bends, second support channels on the second face of the rigid foam core being formed as voids with four bends and configured to fit corresponding supports having six bends;

inserting a plurality of first supports into the voids provided by the first support channels such that one face of each of the plurality of first supports being external to the first face of the rigid foam core and substantially flush with the first face of the rigid foam core, each of the plurality of first supports being fabricated as a structure having four bends and including a portion corresponding to a shape of the first support channels, wherein each of the plurality of first supports has a hat channel shape in cross-section; and inserting a plurality of second supports into the voids provided by the second support channels such that one face of each of the plurality of second supports being external to the second face of the rigid foam core and substantially flush with the second face of the rigid foam core, each of the plurality of second supports being fabricated as a structure having six bends and including a portion corresponding to a shape of the second support channels.

2. The method as claimed in claim 1 including joining a structural insulated roof panel with a structural insulated wall panel in a substantially perpendicular arrangement using a strap.

3. The method as claimed in claim 1 including joining two structural insulated roof panels with rigid foam cores at a building truss.

4. The method as claimed in claim 1 including joining a cantilevered structural insulated roof panel with a rigid foam core with a structural insulated wall panel with a rigid foam core as configured for a load-bearing condition.

5. The method as claimed in claim 1 including joining a structural insulated roof panel with a rigid foam core with a structural insulated wall panel with a rigid foam core as configured for a load-bearing condition.

6. The method as claimed in claim 1 including joining a structural insulated roof panel with a rigid foam core with a structural insulated wall panel with a rigid foam core as configured for a non-load-bearing condition.

7. The method as claimed in claim 1 including joining a cantilevered structural insulated roof panel with a rigid foam core with a structural insulated wall panel with a rigid foam core as configured for a non-load-bearing condition.

8. The method as claimed in claim 1 including joining a structural insulated roof panel with a rigid foam core with a structural insulated wall panel with a rigid foam core.

* * * * *